US012578171B2

(12) United States Patent
Mizek et al.

(10) Patent No.: US 12,578,171 B2
(45) Date of Patent: Mar. 17, 2026

(54) EXPANDABLE BROADHEAD FOR ARROW

(71) Applicant: EASTON TECHNICAL PRODUCTS, INC., Salt Lake City, UT (US)

(72) Inventors: Robert S. Mizek, Lemont, IL (US); Dillon L Ponder, Sandy, UT (US); Clint J. Warner, South Jordan, UT (US); Joshua Kennedy, West Valley City, UT (US)

(73) Assignee: Easton Technical Products, Inc., Salt Lake City, UT (US)

( * ) Notice: Subject to any disclaimer, the term of this patent is extended or adjusted under 35 U.S.C. 154(b) by 230 days.

(21) Appl. No.: 18/450,927

(22) Filed: Aug. 16, 2023

(65) Prior Publication Data

US 2025/0060201 A1 Feb. 20, 2025

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 6,910,979 | B2 | 6/2005 | Barrie et al. | |
| 7,234,220 | B1 * | 6/2007 | Grace, Jr. | F42B 6/08 29/434 |
| 8,016,704 | B1 | 9/2011 | Vandewater | |
| 8,105,187 | B1 | 1/2012 | Sanford | |
| 8,128,521 | B1 | 3/2012 | Ulmer | |
| 8,210,972 | B2 | 7/2012 | Adams et al. | |
| 8,287,407 | B1 | 10/2012 | Sanford | |
| 8,328,667 | B2 | 12/2012 | Adams et al. | |
| 8,911,311 | B1 | 12/2014 | Mizek et al. | |
| 9,329,006 | B1 | 5/2016 | Hansen | |
| 10,168,130 | B1 * | 1/2019 | Wang | F42B 6/08 |
| 11,033,011 | B2 * | 6/2021 | Isringhausen | A01K 81/04 |
| 12,092,444 | B2 * | 9/2024 | Miller | F42B 6/08 |
| 2010/0173734 | A1 * | 7/2010 | Robbins | F42B 6/08 473/583 |
| 2016/0138897 | A1 | 5/2016 | Williamson | |

OTHER PUBLICATIONS

"Triplepoint Outdoors Clovis Broadhead", Triplepointoutdoors.com.

* cited by examiner

*Primary Examiner* — John A Ricci
(74) *Attorney, Agent, or Firm* — DORSEY & WHITNEY LLP

(57) ABSTRACT

A broadhead for an archery bow. The broadhead includes a member, a first blade, a second blade, and a magnet. The first blade and the second blade are coupled to the member. The first blade and the second blade form a plane. The magnet is at least partially disposed within the member. In some examples, the magnet has a longitudinal axis extending perpendicular to the plane. In some examples, each of the first and second blades have respective cutout regions interfacing the magnet while the broadhead is in a first configuration and/or a second configuration.

20 Claims, 15 Drawing Sheets

EXPANDABLE BROADHEAD FOR ARROW

TECHNICAL FIELD

The present disclosure generally relates to archery equipment and specifically relates to broadheads for archery bows.

BACKGROUND

Archery bows, such as, recurve bows, compound bows, and crossbows, utilize arrows, bolts, or other projectiles. These projectiles can be coupled with various tips, points, and/or broadheads depending on the desired application for the projectile. For example, field points are commonly affixed to arrows or bolts when an archer desires to shoot foam archery targets. While hunting wild game, an archer may desire arrows or bolts having broadheads affixed thereto. Broadheads can include one or more blades extending from a ferrule or shank. One or more of these broadhead blades can be rigidly affixed to the ferrule. Additionally, or alternatively, one or more of the blades can be rotatably or slidably affixed to the ferrule. Arrow components, such as broadheads, for arrows, bolts, or other projectiles can be improved to advantageously impact an archer's shooting experience, performance, and overall satisfaction with archery equipment.

SUMMARY

One aspect of the present disclosure relates to a broadhead including a member, a first blade, a second blade, and a magnet. The first blade is pivotably coupled to the member. The second blade is pivotably coupled to the member. The first blade and the second blade form a plane. The magnet is at least partially disposed within the member. The magnet has a longitudinal axis extending perpendicular to the plane.

In some examples, the magnet can be diametrically magnetized. In some examples, the first blade is pivotable about an axis of rotation. The second blade can be pivotable about the axis of rotation. The axis of rotation can extend parallel to the longitudinal axis. In some examples, the first blade and the second blade can contact the magnet in a first configuration. The first blade and the second blade can be displaced from the magnet in a second configuration. In some examples, the magnet is cylindrical and the first and second blades can contact a sidewall of the cylinder in the first configuration.

In some examples, the magnet is cuboid. The first blade can contact a first sidewall of the cuboid in the first configuration. The second blade can contact a second sidewall of the cuboid in the first configuration. In some examples, the longitudinal axis extends orthogonal to the plane. In some examples, the member can define a proximal end configured to engage a component for coupling the broadhead to an arrow shaft. In some examples, the magnet can be disposed closer to the proximal end than a distal end of the member. In some examples, a first pole of the magnet and a second pole of the magnet can disposed on respective curved surfaces located on opposite sides of the magnet.

Another aspect of the disclosure relates to a broadhead including a member, a first blade, a second blade, and a magnet. The first blade is coupled to the member. The first blade has a first cutout region defining a first section of a periphery of the first blade. The second blade is coupled to the member. The second blade has a second cutout region defining a second section of a periphery of the second blade.

The magnet is at least partially disposed within the member. The first cutout region contacts the magnet at a first location on the magnet. The second cutout region contacts the magnet at a second location on the magnet.

In some examples, the magnet can be diametrically magnetized. In some examples, the first cutout region and the second cutout region are displaced from the magnet in a second configuration. In some examples, the first blade can contact the magnet at the first location on the magnet in a first configuration. The second blade can contact the magnet at the second location on the magnet in the first configuration. The first blade can contact the magnet at a third location on the magnet in a second configuration. The second blade can contact the magnet at a fourth location on the magnet in the second configuration. In some examples, the first blade can be repositionable relative to the member while transitioning between the first configuration and the second configuration. In some examples, the magnet can be disposed closer to a distal end of the member than a proximal end of the member.

Yet another aspect of the present disclosure relates to a broadhead including a member, a first blade, a second blade, and a magnet. The first blade is coupled to the member via a feature defining an axis of rotation for the first blade. The second blade is coupled to the member via the feature further defining an axis of rotation for the second blade. The magnet is coupled to the member. The magnet has a diameter. The first blade has a first point of contact on the magnet. The second blade has a second point of contact on the magnet. The first point of contact and the second point of contact define a gap between the first blade and the second blade. The gap is less than the diameter of the magnet.

In some examples, the member can have a proximal end and a distal end. The feature can be nearer the proximal end than the distal end. In some examples, the first point of contact and the second point of contact can be nearer the distal end than the proximal end. In some examples, the magnet can be diametrically magnetized.

The above summary of the present invention is not intended to describe each embodiment or every implementation of the present invention. The Figures and the detailed description that follow more particularly exemplify one or more example embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1A:
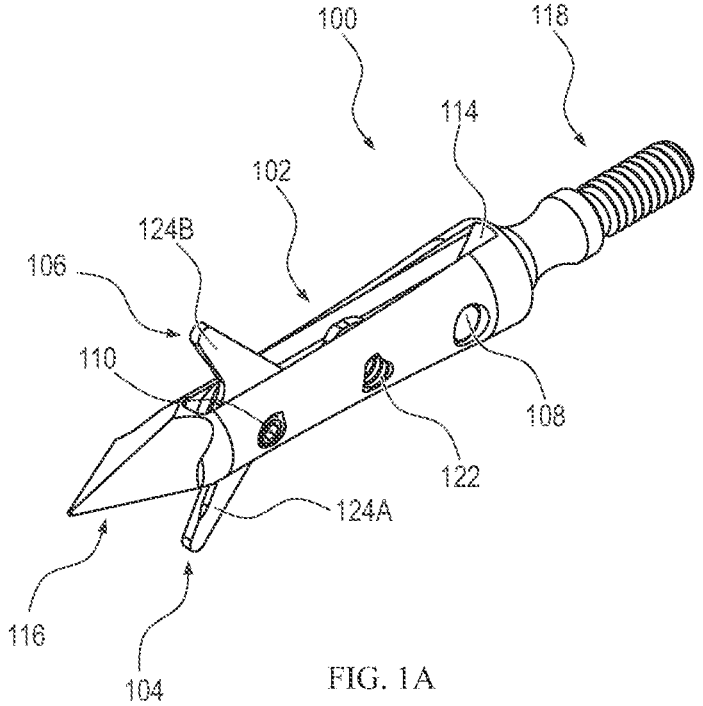
FIG. 1A is a perspective side view of a broadhead for an archery bow in a first configuration, according to some embodiments.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

Broadheads affixable to projectiles, such as arrows and bolts, can provide a cutting utility via one or more blades incorporated into the broadhead. Some broadheads can include one or more blades that are fixed relative to the ferrule or main shaft of the broadhead (i.e., a fixed-blade broadhead). For example, one or more of the blades can be rigidly affixed to the ferrule such that the blade is immobile relative to the ferrule. Some broadheads can include one or more blades that are pivotably and/or slidably affixed to the ferrule (i.e., a mechanical broadhead). For example, one or more of the blades can rotate and/or translate relative to the ferrule to open or deploy upon impact with a target. Some broadheads can include a plurality or set of blades wherein a portion of the set of blades are rigidly affixed to the ferrule and a portion of the set of blades are pivotably and/or slidably affixed to the ferrule (i.e., a hybrid broadhead).

Mechanical broadheads and hybrid broadheads can include one or more blades that pivot and/or slide relative to the ferrule upon impact to increase a cutting diameter of the broadhead or otherwise deploy sharpened edges of the one or more cutting blades to form a cutting path as the broadhead passes through the target. The blades can therefore be characterized as having a retracted or partially retracted state and a deployed state. A broadhead that remains in retracted state while the arrow is in flight and not having contacted or having passed through a target can be beneficial. For example, one or more blades that remain completely within or partially within a ferrule will be aerodynamically more efficient and effective than if the blades extend outside of the ferrule, and thereby can render the projectile more accurate and repeatably precise. Additionally, a broadhead having one or more blades that remain in a retracted state until contacting or entering a target can be less likely to accidentally cut or damage archery equipment that comes into contact with the broadhead (e.g., a bow string). Additionally, a broadhead having blades that remain in a retracted state can maintain a smaller profile or footprint to enable more compact arrow storage (e.g., within an arrow quiver). Some mechanical broadheads include an O-ring or other elastic disposed about the ferrule to at least partially retain the blades within the ferrule in a retracted state until the broadhead strikes the target. Thereafter, the blades can deploy upon impact of the target to cut or break the O-ring.

According to one aspect of the present disclosure, a broadhead can include a member or body, a first blade, a second blade, and a magnet. The first blade can be pivotably coupled to the member. The second blade can be pivotably coupled to the member. The first blade and the second blade can define or form a plane. The magnet can be at least partially disposed within the member. For example, the magnet can be press-fit, adhered, fastened, or otherwise coupled to the member. The magnet can have a longitudinal axis that extends perpendicular to the plane. For example, the longitudinal axis can intersect the plane. In some examples, the magnet can be diametrically charged such that the poles of the magnet are located on lateral sides (one or more sidewalls) of the magnet facing the first and second blades. The first and second blades can rotate about an axis of rotation. The axis of rotation can extend parallel to the longitudinal axis. In some examples, a dimension of the magnet, such as, a width, a height, and/or a length, can be substantially similar to or equivalent to an outer-diameter of the body or member. In other words, the magnet can extend through a majority of the portion or section of the member that the magnet is disposed within. In this way, the relatively small width or diameter of the magnet can accommodate at least partial blade retention within the member while the relatively large overall size of the magnet can generate beneficial magnetic forces to retain the first and second blades.

According to another aspect of the present disclosure, the broadhead can additionally, or alternatively, include one or more blades having a cutout region that defines a section of a periphery of the blade. In some examples, the section of the periphery of the blade formed or defined by the cutout region can correlate to a shape of the magnet disposed within the member. For example, the cutout region can be semi-circular if the magnet is cylindrical such that the cutout region maximizes a surface area of the magnet contacted by the blade while the blade is in the retracted state. In some examples, the cutout region can have linear segments correlating to a magnet having a cuboid shape with one or more planar lateral sides. While in the retracted state, two or more blades of the broadhead can contact the magnet at respective cutout regions such that a gap or spacing is formed between the blades. The gap or spacing between the blades can be relatively smaller or narrower due to the cutout regions. For example, the cutout region on each blade can act as a recess or void at least partially receiving a portion of the magnet to enable the blades to be disposed relatively closer to one another while retracted than blades without cutout regions.

According to yet another aspect of the present disclosure, two or more blades of the broadhead can be gapped or spaced by a magnet. For example, first and second blades of the broadhead can contact the magnet such that a gap or spacing is formed between the first and second blades at or near the magnet. In some examples, the gap can be measured or defined between respective points where the first and second blades contact the magnet at a magnet surface location disposed nearest a proximal end of the member or ferrule. In some examples, the gap can be measured or defined between other respective points where the first and second blades contact the magnet at a magnet surface location disposed nearest a distal end of the member or ferrule.

In some examples, the gap can be less than a diameter of the magnet. By disposing the first and second blades relatively closer together, the member can be relatively smaller in size and shape, yet still at least partially house or conceal the first and second blades within the member. For example, a diameter of the member at or near the magnet can be reduced without sacrificing the size (e.g., bulk/structural support) of the first and second blades.

The present description provides examples and is not limiting of the scope, applicability, or configuration set forth in the claims. Thus, it will be understood that changes may be made in the function and arrangement of the components and/or other elements of the broadheads discussed without departing from the spirit and scope of the disclosure, and various embodiments may omit, substitute, or add other procedures or components as appropriate. For instance, features described with respect to certain embodiments may be combined in other embodiments. The specific examples shown in the figures and described herein should not, therefore, be considered to limit the breadth of possible embodiments and combinations of possible embodiments contemplated by the present disclosure.

Figure 1B:
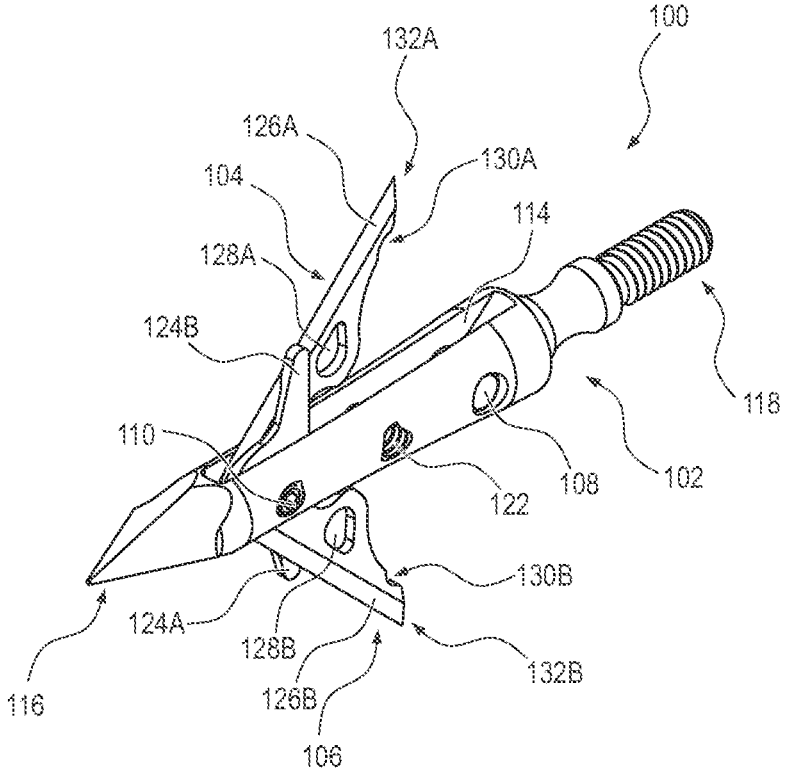
FIG. 1B is a perspective side view of the broadhead in a second configuration, according to some embodiments.
Figure 1C:
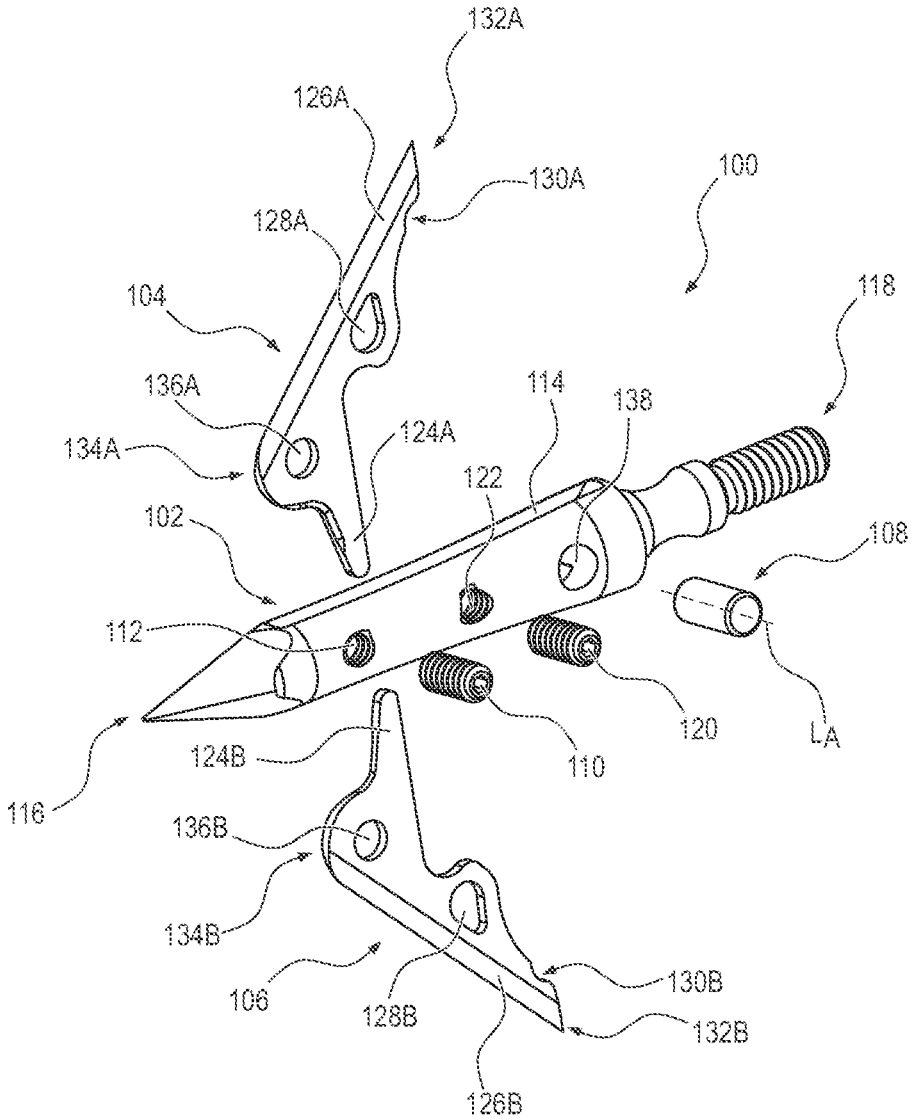
FIG. 1C is an exploded perspective side view of the broadhead, according to some embodiments.

Referring now to the figures in detail, FIGS. 1A-1C show a broadhead 100. More specifically, FIG. 1A shows the broadhead 100 in a first state or first configuration wherein the broadhead 100 is in a retracted state. FIG. 1B shows the broadhead 100 in a second state or second configuration wherein the broadhead 100 is in a deployed state. FIG. 1C shows an exploded view of the broadhead 100. The broadhead 100 includes a ferrule, body, or central member 102, a first blade 104, a second blade 106, and a magnet 108. The central member 102 (i.e., the member 102) can at least partially house the first blade 104 and/or the second blade 106. For example, the first and/or second blades 104, 106 can be pivotable and/or slidable about a fastener or other feature 110 disposed within or defined by the member 102. In other words, the first and/or second blades 104, 106 can be pivotable such that the blades are retractable and deployable relative to the member 102. The feature 110 can be a fastener, a pin, or other structure defining an axis of rotation $A_R$ the first and second blades 104, 106 can rotate about. See FIGS. 1D-1F. The feature 110 can be disposed within an aperture 112 or other recess defined by the member 102.

In some examples, the member 102 can include one or more slots or channels 114 and the first and/or second blades 104, 106 can be at least partially disposed within the channels 114 while retracted (e.g., the first configuration) or deployed (e.g., a second configuration). While the broadhead 100 shown in FIGS. 1A-1I depict the first and second blades 104, 106 disposed within a single shared channel 114, in other examples, each of the first and second blades 104, 106 can be disposed within respective and discrete channels 114. The magnet 108 can be partially disposed within the channel 114 such that the first and second blades 104, 106 contact the magnet 108 while in the first configuration.

In some examples, a distal end 116 of the member 102 can form or define a chisel or other sharpened or pointed structure configured to pierce a target. In some examples, a proximal end 118 of the member 102 can form or define an engagement structure (e.g., a threaded interface) that enables the broadhead 100 to be coupled with an arrow shaft (e.g., an arrow insert or out-sert). In some examples, a locking feature 120 can be at least partially received within an aperture 122 of the member 102. The locking feature 120 can be insertable or removable from the aperture 122 of the member 102 to selectively retain the first and second blades 104, 106 in the first configuration (i.e., the retracted state).

The first blade 104 can be pivotably and/or slidably coupled to the member 102 about the feature 110. For example, the first blade 104 can include a lever-arm 124A that is forced to rotate about the feature 110 (i.e., about the axis of rotation $A_R$) when inertia drives the broadhead 100 into and through a target. Rotation of the lever-arm 124A causes a blade portion 126A of the first blade 104 to extend or deploy out of the channel 114. In some examples, the first blade 104 can include a through-hole 128A located and sized to at least partially receive the locking feature 120 to retain the first blade 104 in a retracted state (e.g., housing the blade portion 126A within the channel 114 of the member 102). For example, the locking feature 120 can be a set screw that is inserted into the aperture 122 and situated within the through-hole 128A to prevent the blade portion 126A from deploying out of the channel 114.

The second blade 106 can be pivotably and/or slidably coupled to the member 102 about the feature 110. For example, the second blade 106 can include a lever-arm 124B that is forced to rotate about the feature 110 (i.e., about the axis of rotation $A_R$) when inertia drives the broadhead 100 into and through a target. Rotation of the lever-arm 124B causes a blade portion 126B of the second blade 106 to extend or deploy out of the channel 114. In some examples, the second blade 106 can include a through-hole 128B located and sized to at least partially receive the locking feature 120 to retain the second blade 106 in a retracted state (e.g., housing the blade portion 126B within the channel 114 of the member 102). For example, the locking feature 120 can be a set screw that is inserted into the aperture 122 and situated within the through-hole 128B to prevent the blade portion 126B from deploying out of the channel 114.

In some examples, each of the first and second blades 104, 106 can include respective cutout regions 130A, 130B defining a section of a periphery of each of the blades 104, 106. The cutout regions 130A, 130B can be disposed opposite the respective blade portions 126A, 126B. In some examples, the cutout regions 130A, 130B can be formed or defined nearer a distal end 132A, 132B than a proximal end 134A, 134B of their respective blades 104, 106. In some examples, each of the first and second blades 104, 106 can include an aperture 136A, 136B enabling rotation and/or translation of the blades relative to the feature 110 and the axis of rotation $A_R$ when the first and second blades 104, 106 are coupled within the slot 114 of the member 102.

In some examples, the section of the periphery of the first blade 104 formed or defined by the cutout region 130A can correlate to a shape of the magnet 108 disposed within the member 102. For example, the cutout region 130A can be semi-circular if the magnet 108 is cylindrical such that the cutout region 130A maximizes a surface area of the first blade 104 contacted by the magnet 108 while the first blade 104 is in the first configuration (i.e., retracted state). Or, stated another way, the cutout region 130A can maximize a surface area of the magnet 108 contacted by the first blade 104 while the first blade 104 is in the first configuration (i.e., retracted state). In some examples, the cutout region 130A can have linear segments, for example, correlating to a magnet 108 having a cuboid shape with one or more planar lateral sides.

In some examples, the section of the periphery of the second blade 106 formed or defined by the cutout region 130B can correlate to a shape of the magnet 108 disposed within the member 102. For example, the cutout region 130B can be semi-circular if the magnet 108 is cylindrical such that the cutout region 130B maximizes a surface area of the second blade 106 contacted by the magnet 108 while the second blade 106 is in the first configuration (i.e., retracted state). Or, stated another way, the cutout region 130B can maximize a surface area of the magnet 108 contacted by the second blade 106 while the second blade 106 is in the first configuration (i.e., retracted state). In some examples, the cutout region 130B can have linear segments, for example, correlating to a magnet 108 having a cuboid shape with one or more planar lateral sides.

In some examples, the magnet 108 can be disposed within an aperture 138 defined or formed by the body or member 102. For example, the magnet 108 can be adhered, fastened, press-fit, or otherwise coupled within the aperture 138. In some examples, the magnet 108 can be disposed closer to the proximal end 118 of the member 102 than the distal end 116 of the member 102. In some examples, the magnet 108 can be diametrically charged or diametrically magnetized. For example, the magnet 108 can be a cylindrical magnet having north and south poles located on curved surfaces on opposite sides of the cylinder (e.g., a sidewall of the cylinder). In other examples, the magnet 108 can be cuboid or otherwise consist of multiple planar surfaces which adjoin to form a three-dimensional shape. The magnet 108 can have a longitudinal axis LA extending through a centroid from one end of the magnet 108 to the other end of the magnet 108 and along the longest dimension. In other words, the longitudinal axis LA extends through the center of curvature (i.e., at the radius or center point) of the cylinder forming the magnet 108 and between the north and south poles disposed on curved sides of the magnet 108. For example, a first pole of the magnet 108 and a second pole of the magnet 108 can be disposed on respective curved surfaces located on opposite sides of the magnet 108.

Figure 1D:
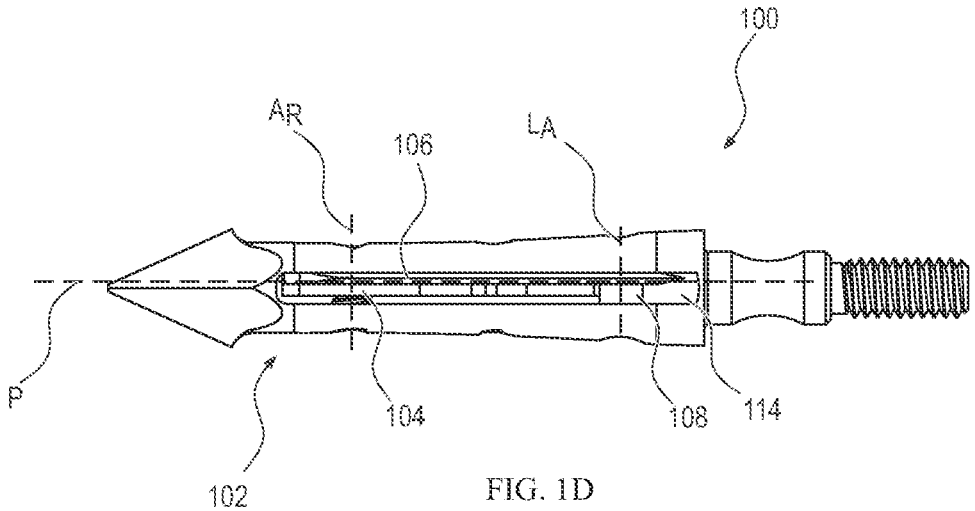
FIG. 1D is a side view of the broadhead in the first configuration, according to some embodiments.
Figure 1E:
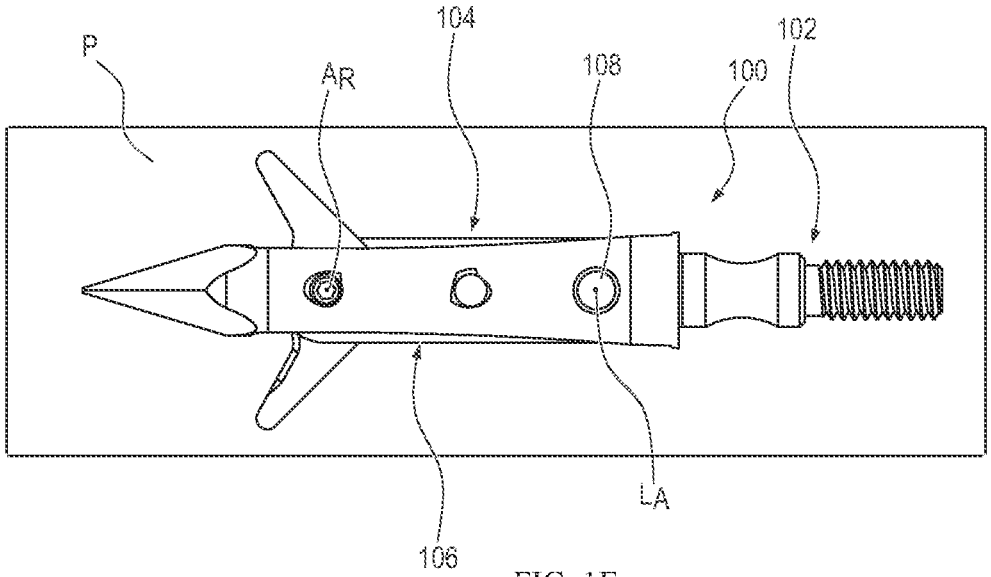
FIG. 1E is a top view of the broadhead in the first configuration, according to some embodiments.

FIGS. 1D and 1E show a side view and a top view, respectively, of the broadhead 100 in the first configuration (i.e., the retracted state). In some examples, one or more of the first and second blades 104, 106 can define a plane P. For example, the plane P can be defined between the first and second blades 104, 106. Alternatively, the plane P can be defined as extending through one of the first or second blades 104, 106. For example, the plane P can be defined as extending through the first blade 104 and along the blade portion 126A or extending through the second blade 106 along the blade portion 126B. FIG. 1D shows the plane P extending through the second blade 106 along the blade portion 126B. In some examples, the longitudinal axis LA can extend perpendicular to the plane P. For example, the longitudinal axis LA can intersect the plane P at a 90 degree angle or right angle. In some examples, the longitudinal axis LA can extend orthogonal to the plane P. In some examples, the axis of rotation $A_R$ can extend parallel to the longitudinal axis LA and perpendicular to the plane P.

Figure 1F:
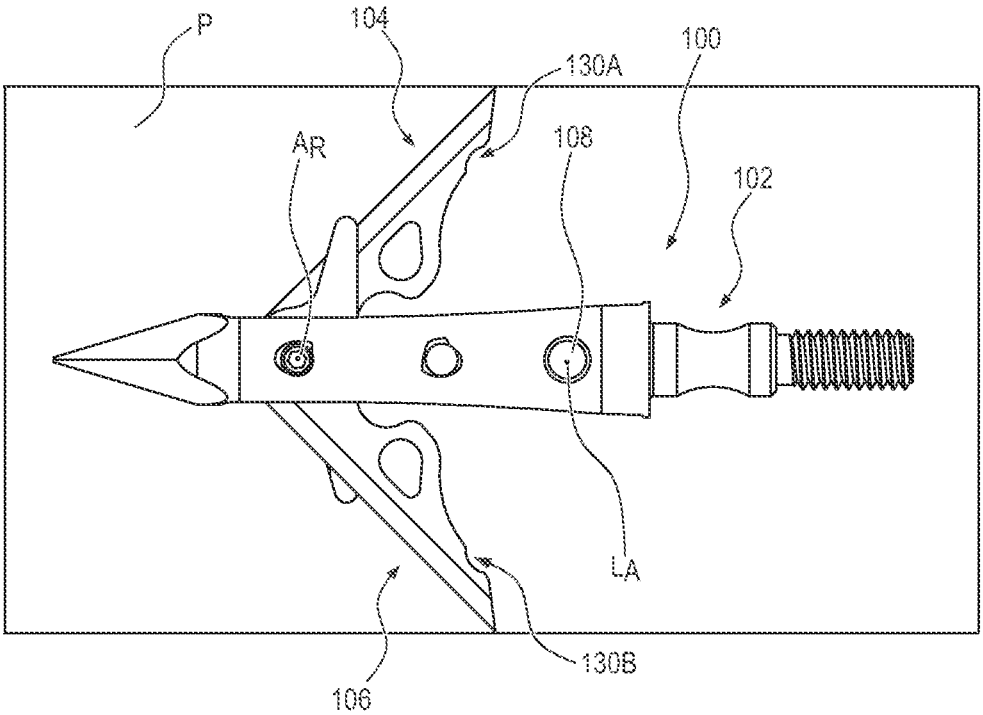
FIG. 1F is a side view of the broadhead in the second configuration, according to some embodiments.

FIG. 1F shows a top view of the broadhead 100 in the second configuration (i.e., deployed state). The longitudinal axis LA can extend parallel to the axis of rotation $A_R$. Additionally, or alternatively, both the longitudinal axis LA and the axis of ration $A_R$ can be orientated perpendicular and/or orthogonal to the plane P. While the plane P is shown as extending dimensions relative to the first and second blades 104, 106 and the body or member 102, the plane P can be defined as having any width or length relative to first and/or second blades 104, 106 and/or the member 102. In the second configuration, the respective cutout regions 130A, 130B of the first and second blades 104, 106 can be displaced from the magnet 108. In other words, the respective sections of the periphery of the first and second blades 104, 106 can be displaced or distanced from the magnet 108 while the broadhead 100 is in the second configuration.

Figure 1G:
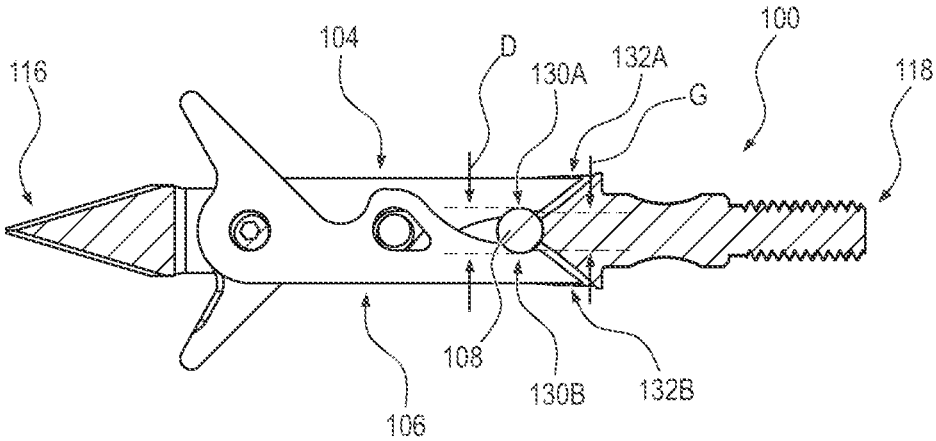
FIG. 1G is a cross-sectional top view of the broadhead in the first configuration, according to some embodiments.
Figure 1H:
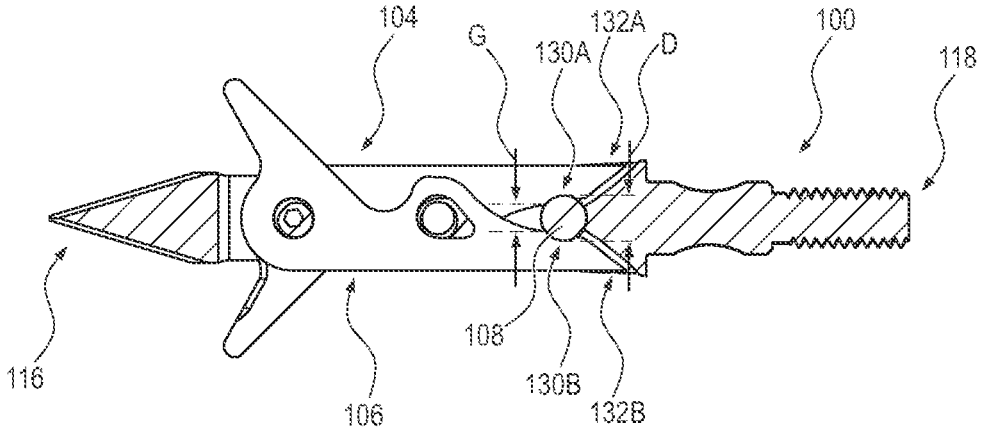
FIG. 1H is a cross-sectional top view of the broadhead in the first configuration, according to some embodiments.
Figure 1I:
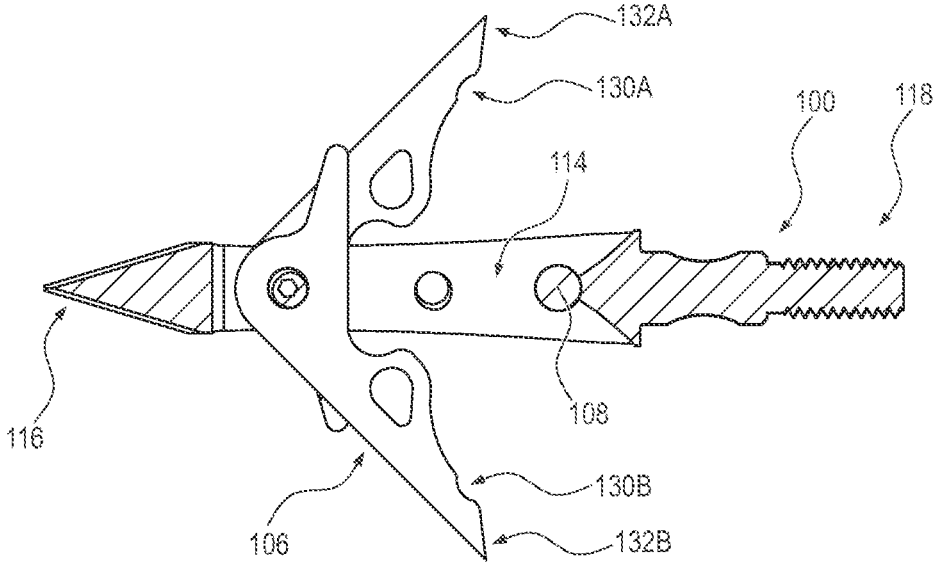
FIG. 1I is a cross-sectional top view of the broadhead in the second configuration, according to some embodiments.

FIGS. 1G and 1H show top cross-sectional views of the broadhead 100 in the first configuration. FIG. 1I shows a top cross-sectional view of the broadhead 100 in the second configuration. The cross-section is taken through the plane P shown in FIG. 1D. While in the first configuration, the first and second blades 104, 106 of the broadhead 100 can contact the magnet 108 at the respective cutout regions 130A, 130B such that a gap G or spacing is formed between the first and second blades 104, 106 at or near the magnet 108. In some examples, the gap G can be measured or defined between respective points where the first and second blades 104, 106 contact the magnet 108 (e.g., where the contact points are disposed nearest the proximal end 118 of the member 102). In other words, the gap G can be measured or defined between the magnet contact points of the blades disposed nearest the proximal end 118 of the member 102. See FIG. 1G. In some examples, the gap G can be measured or defined between other respective contact points where the first and second blades 104, 106 contact the magnet 108 (e.g., where such other contact points are disposed nearest the distal end 116 of the member 102). In other words, the gap G can be measured or defined between the magnet contact points of the blades disposed nearest the distal end 116 of the member 102.

In some examples, the gap G can be less than a diameter D of the magnet 108. The gap G or spacing between the first and second blades 104, 106 can be relatively smaller or narrower due to the cutout regions 130A, 130B. For example, the respective cutout region 130A, 130B on each of the first and second blades 104, 106 can act as a recess or void at least partially receiving a portion of the magnet 108 to enable the first and second blades 104, 106 to be disposed relatively closer to one another while in the first configuration than broadhead blades without cutout regions 130A, 130B. By disposing the first and second blades 104, 106 relatively closer together via the cutout regions 130A, 130B, the member 102 can be relatively smaller in size and shape (e.g., a diameter of the member at or near the magnet 108)

yet still completely or partially house or conceal the first and second blades 104, 106 within the channel 114. For example, a diameter of the member 102 at or near the magnet 108 can be reduced without sacrificing the size (e.g., bulk/structural support) of the first and second blades 104, 106.

Figure 2A:
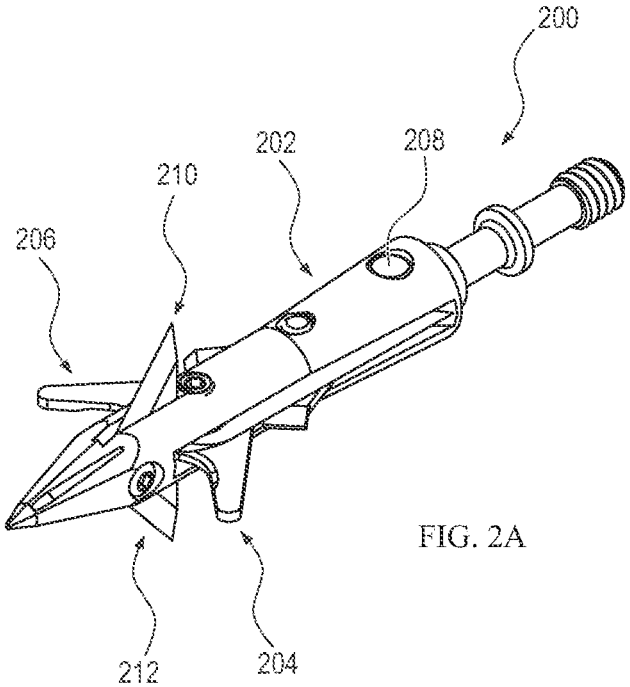
FIG. 2A is a perspective side view of a broadhead in a first configuration, according to some embodiments.
Figure 2B:
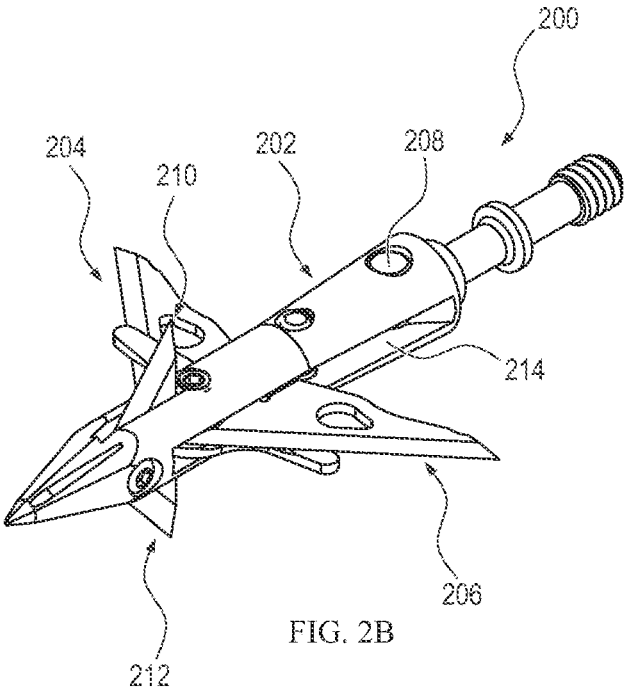
FIG. 2B is a perspective side view of the broadhead in a second configuration, according to some embodiments.

FIGS. 2A and 2B show a broadhead 200 in a first configuration and a second configuration, respectively. The broadhead 200 can be substantially similar to, and can include some or all of, the features of the broadhead 100. For example, the broadhead 200 can include a body or member 202, a first blade 204, a second blade 206, and a magnet 208. Each of the member 202, the first blade 204, the second blade 206, and the magnet 208 can operate as described herein with reference to FIGS. 1A-1I. For example, the first and second blades 204, 206 can be rotatable about an axis of rotation (e.g., see axis of rotation $A_R$ in FIG. 1D) and contact the magnet 208 while in the first configuration. Contact with the magnet 208 in the first configuration can retain the first and/or second blades 204, 206 at least partially housed within the member 202. For example, the first and second blade 204, 206 can be at least partially disposed within a channel 214 defined by or formed within the member 202.

In some examples, the broadhead 200 can include a third blade 210 and a fourth blade 212. The third and fourth blades 210, 212 can be stationary or fixed relative to the member 202 while the first and second blades 204, 206 can be deployable or pivotable relative to the member 202. In some examples, the third blade 210 and/or the fourth blade 212 can extend parallel to a longitudinal axis of the magnet 208 (see longitudinal axis LA in FIGS. 1C-1F). Additionally, or alternatively, the third blade 210 and/or the fourth blade 212 can extend perpendicular to a plane defined by the first and/or second blades 204, 206 (see plane P in FIGS. 1D-1F).

Figure 3A:
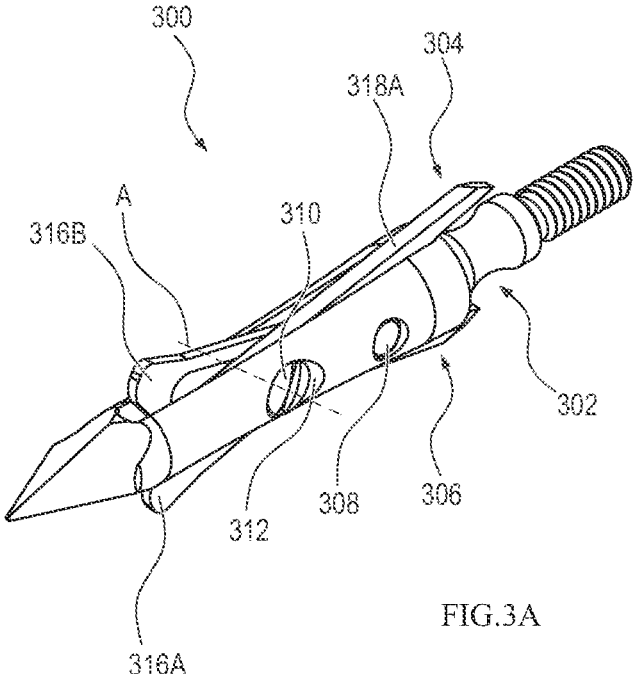
FIG. 3A is a perspective side view of a broadhead in a first configuration, according to some embodiments.
Figure 3B:
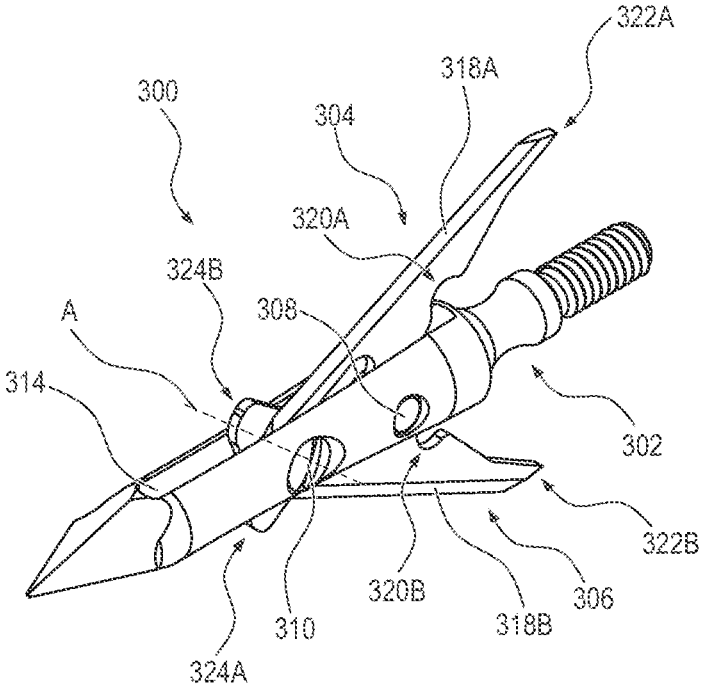
FIG. 3B is a perspective side view of the broadhead in a second configuration, according to some embodiments.

FIGS. 3A and 3B show another example of a broadhead 300 according to one or more aspects of the present disclosure. FIG. 3A shows the broadhead 300 in a first configuration (e.g., a retracted state). FIG. 3B shows the broadhead 300 in a second configuration (e.g., a deployed state). The broadhead 300 can be substantially similar to, and can include some or all of, the features of the broadheads 100, 200. For example, the broadhead 300 can include a body or member 302, a first blade 304, a second blade 306, and a magnet 308. The member 302 can at least partially house the first blade 304 and/or the second blade 306. For example, the first and/or second blades 304, 306 can be pivotable and/or slidable about a fastener or other feature 310 coupled to the member 302. In other words, the first and/or second blades 304, 306 can be pivotable such that the blades are retractable and deployable relative to the member 302 (e.g., within a slot or channel 314). The feature 310 can be a fastener, a pin, or other structure defining an axis A. The first and second blades 304, 306 can slide relative to and/or rotate about axis A. The feature 310 can be disposed within an aperture 312 (e.g., a threaded aperture) or other recess defined by the member 302.

The first blade 304 can be pivotably and slidably coupled to the member 302 about the feature 310. For example, the first blade 304 can include a lever-arm 316A that is forced to rotate and slide relative to the feature 310 when inertia drives the broadhead 300 into and through a target. Rotation and translation of the lever-arm 316A causes a blade portion 318A of the first blade 304 to further extend or deploy from the member 302 as shown in FIG. 3B, and thereby transition from the retracted state shown in FIG. 3A. The second blade 306 can be pivotably and slidably coupled to the member 302 about the feature 310. For example, the second blade 306 can include a lever-arm 316B that is forced to rotate and slide relative to the feature 310 when inertia drives the broadhead 300 into and through a target. Rotation and translation of the lever-arm 316B causes a blade portion 318B of the second blade 306 to further extend or deploy from the member 302 as shown in FIG. 3B (thereby transitioning from the retracted state shown in FIG. 3A).

In some examples, each of the first and second blades 304, 306 can include respective cutout regions 320A, 320B defining a section of a periphery of each of the blades 304, 306. In some examples, the cutout regions 320A, 320B can be disposed opposite the respective blade portions 318A, 318B. In some examples, the cutout regions 320A, 320B can be formed or defined nearer a distal end 322A, 322B than a proximal end 324A, 324B of their respective blades 304, 306. In some examples, the cutout regions 320A, 320B can be formed or defined nearer the proximal end 324A, 324B than the distal end 322A, 322B of their respective blades 304, 306. In some examples, each of the first and second blades 304, 306 can include a respective slot 326A, 326B enabling rotation and translation of the blades relative to the feature 310 and the axis A (see FIGS. 3C and 3D). In particular examples, the blades 304, 306 are coupled to the member 302 at a first portion of the blades 304, 306. In addition, the blades 304, 306 can include the cutout regions 320A, 320B positioned at a second portion of the blades 304, 306. In these or other examples, the first and second portions of the blades 304, 306 are positioned at different areas. Further, the cutout regions 320A, 320B can be positioned along a periphery portion of the blades 304, 306 while the feature 310 (coupling the blades 304, 306 to the member 302) may be disposed within an interior portion of the blades 304, 306.

In some examples, the section of the periphery of the first blade 304 formed or defined by the cutout region 320A can correlate to (e.g., compliment or at least partially match) a shape of the magnet 308 disposed within the member 302. For example, the cutout region 320A can be semi-circular if the magnet 308 is cylindrical such that the cutout region 320A maximizes a surface area of the first blade 304 contacted by the magnet 308 while the first blade 304 is in the first configuration (i.e., retracted state). Or, stated another way, the cutout region 320A can maximize a surface area of the magnet 308 contacted by the first blade 304 while the first blade 304 is in the first configuration (i.e., retracted state). In some examples, the cutout region 320A can have linear segments correlating to a magnet 308 having a cuboid shape with one or more planar lateral sides.

In some examples, the section of the periphery of the second blade 306 formed or defined by the cutout region 320B can correlate to a shape of the magnet 308 disposed within the member 302. For example, the cutout region 320B can be semi-circular if the magnet 308 is cylindrical such that the cutout region 320B maximizes a surface area of the second blade 306 contacted by the magnet 308 while the second blade 306 is in the first configuration (i.e., retracted state). Or, stated another way, the cutout region 320B can maximize a surface area of the magnet 308 contacted by the second blade 306 while the second blade 306 is in the first configuration (i.e., retracted state). In some examples, the cutout region 320B can have linear segments correlating to a magnet 308 having a cuboid shape with one or more planar lateral sides. Additionally or alternatively, the cutout regions 320A, 320B can generally nest about or position along one or more surfaces of the magnet.

Figure 3C:
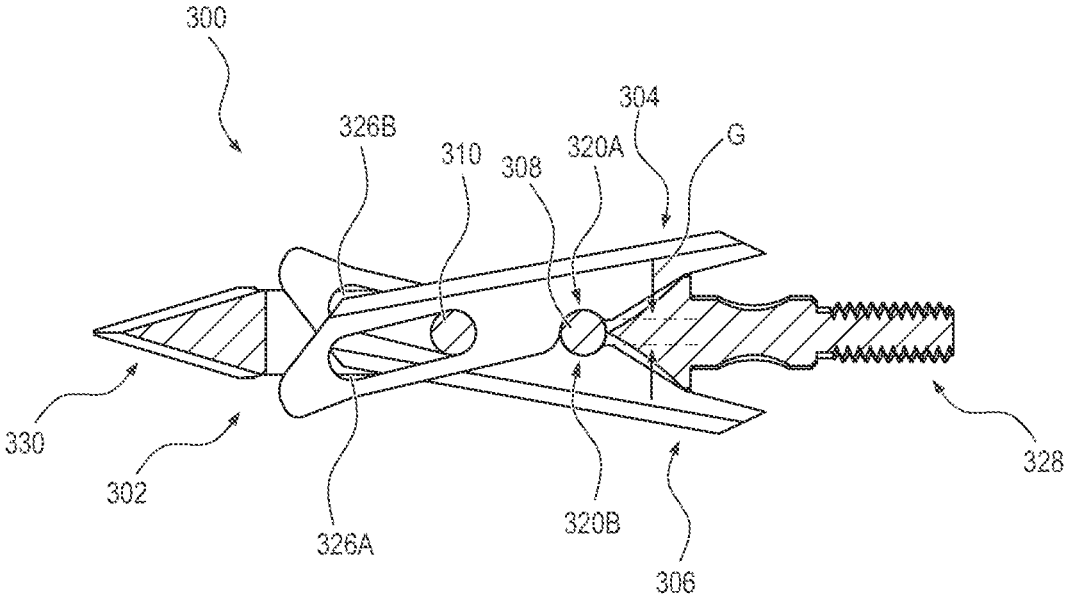
FIG. 3C is a cross-sectional top view of the broadhead in the first configuration, according to some embodiments.
Figure 3D:
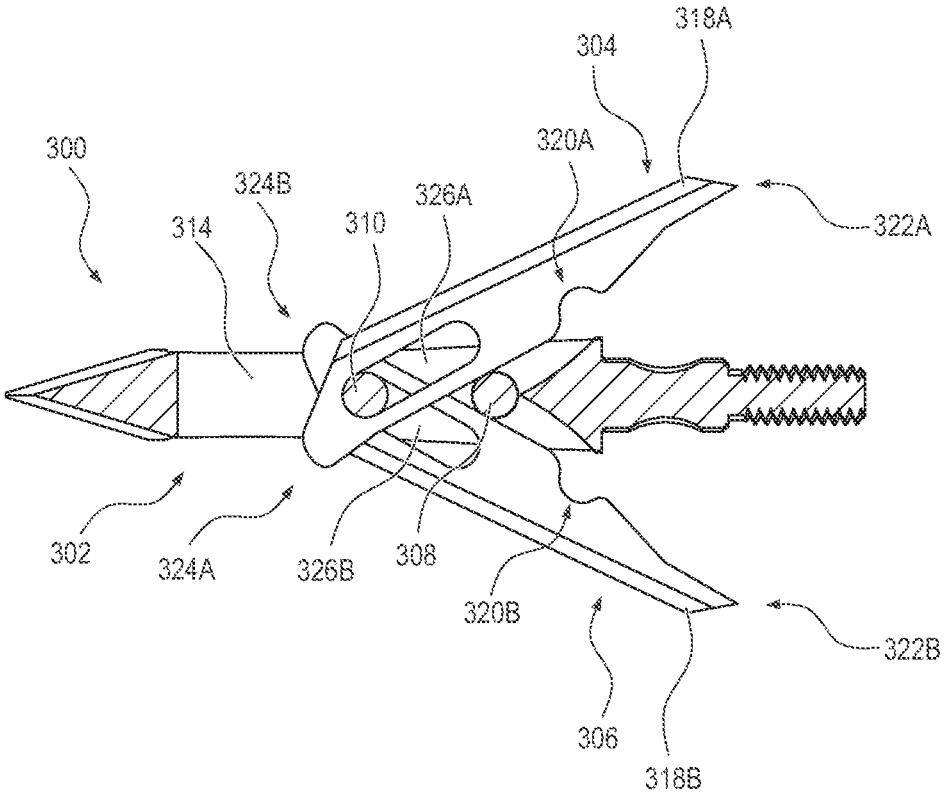
FIG. 3D is a cross-sectional top view of the broadhead in the second configuration, according to some embodiments.

FIGS. 3C and 3D show cross-sectional views of the broadhead 300 taken through a plane defined by (or positioned between or adjacent to) the first and second blades 304, 306 (see e.g., plane P in FIGS. 1D-1F). More specifically, FIG. 3C shows a cross-sectional view of the broadhead 300 in the first configuration and FIG. 3D shows a cross-sectional view of the broadhead 300 in the second configuration. In the first configuration, the first and second blades 304, 306 can contact or engage the magnet 308 at their respective cutout regions 320A, 320B. The contact or engagement between the cutout regions 320A, 320B and the magnet 308 can induce a magnetic force on the first and second blades 304, 306 to retain or maintain the broadhead 300 in the first configuration. As the broadhead 300 impacts and begins to pass through a target, the first and second blades 304, 306 can transition from the first configuration to the second orientation. During this transition, each of the cutout regions 320A, 320B can disengage or translate away from the magnet 308 as each of the first and second blades 304, 306 translate and rotate relative to the feature 310. In some examples, the first and/or second blades 304, 306 can include respective slots 326A, 326B and the feature 310 can be disposed within the slots 326A, 326B. As the first and second blades 304, 306 transition from the first configuration to the second configuration, the magnet 308 can continuously or intermittently contact or engage each of the first and second blades 304, 306 between their respective cutout regions 320A, 320B and their respective proximal ends 324A, 324B. Thus, in some examples, the magnet 308 can contact or engage one or both of the first and second blades 304, 306 while the broadhead 300 is in both the first configuration and the second configuration (see e.g., FIGS. 3A-3D). In some examples, the magnet 308 can act as a wedge which drives the distal ends 322A, 322B away from each other as the broadhead 300 transitions from the first configuration to the second configuration. Alternatively, the magnet 308 can contact or engage one or both of the first and second blades 304, 306 only while the broadhead 300 is in the first configuration (see e.g., FIGS. 1A-1I).

In some examples, while in the first configuration, the first and second blades 304, 306 of the broadhead 300 can contact the magnet 308 at the respective cutout regions 320A, 320B such that a gap G or spacing is formed between the first and second blades 304, 306 at or near the magnet 308. The first and second blades 304, 306 can contact (e.g., wrap around or extend along) a surface of the magnet. However, to define the gap G according to some examples, the gap G can be measured or defined between the contact points positioned farthest away from the feature 310 (i.e., where respective contact points for the first and second blades 304, 306 last contact the magnet 308 in the direction of blade sweep away from the feature 310). In other words, the gap G can be measured or defined between the magnet contact points of the blades disposed nearest the proximal end 328 of the member 302. See FIG. 3C. In other examples, the gap G can be measured or defined between respective points where the first and second blades 304, 306 contact the magnet 308 nearest a distal end 330 of the member 302 (see such a gap nearest the distal end in FIGS. 5E-5F).

In some examples, the gap G can be less than a diameter of the magnet 308 (see diameter D in FIGS. 1G and 1H). The gap G or spacing between the first and second blades 304, 306 can be relatively smaller or narrower due to the cutout regions 320A, 320B. For example, the respective cutout region 320A, 320B on each of the first and second blades 304, 306 can act as a recess or void at least partially receiving a portion of the magnet 308 to enable the first and second blades 304, 306 to be disposed relatively closer to one another while in the first configuration than broadhead blades without cutout regions 320A, 320B. By disposing the first and second blades 304, 306 relatively closer together via the cutout regions 320A, 320B the member 302 can be relatively smaller in size and shape (e.g., diameter at or near the magnet 308) yet still partially house or conceal the first and second blades 304, 306 within the channel 314. For example, a diameter of the member 302 at or near the magnet 308 can be reduced without sacrificing the size (e.g., bulk/structure) of the first and second blades 304, 306.

In some examples, the first blade 304 can contact the magnet 308 at a first location on the magnet 308 while the broadhead 300 is in the first configuration. See FIG. 3C. Similarly, the second blade 306 can contact the magnet 308 at a second location on the magnet 308 while the broadhead 300 is in the first configuration. See FIG. 3C. In some examples, the first blade 304 can contact the magnet 308 at a third location on the magnet 308, different from the first location, while the broadhead 300 is in the second configuration. See FIG. 3D. Similarly, the second blade 306 can contact the magnet 308 at a fourth location on the magnet 308, different from the second location, while the broadhead 300 is in the second configuration. In some examples, the first location and the third location can partially overlap. In some examples, the second location and the fourth location can partially overlap.

Figure 4A:
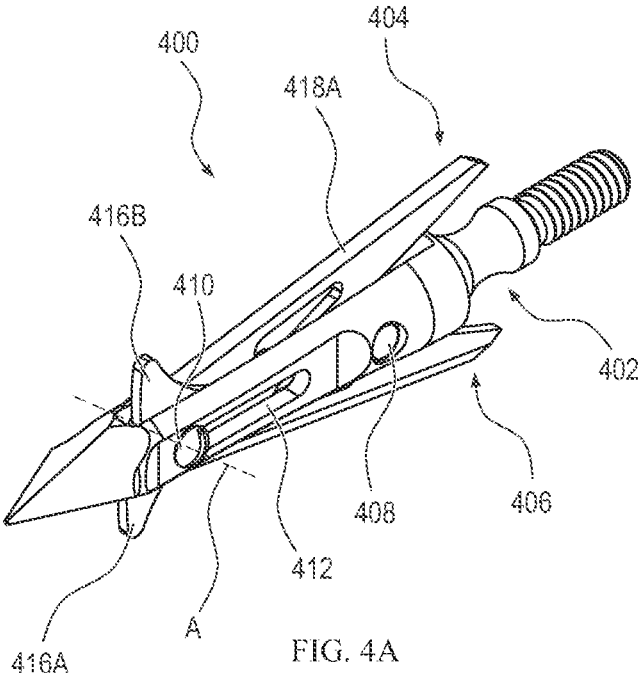
FIG. 4A is a perspective side view of a broadhead in a first configuration, according to some embodiments.
Figure 4B:
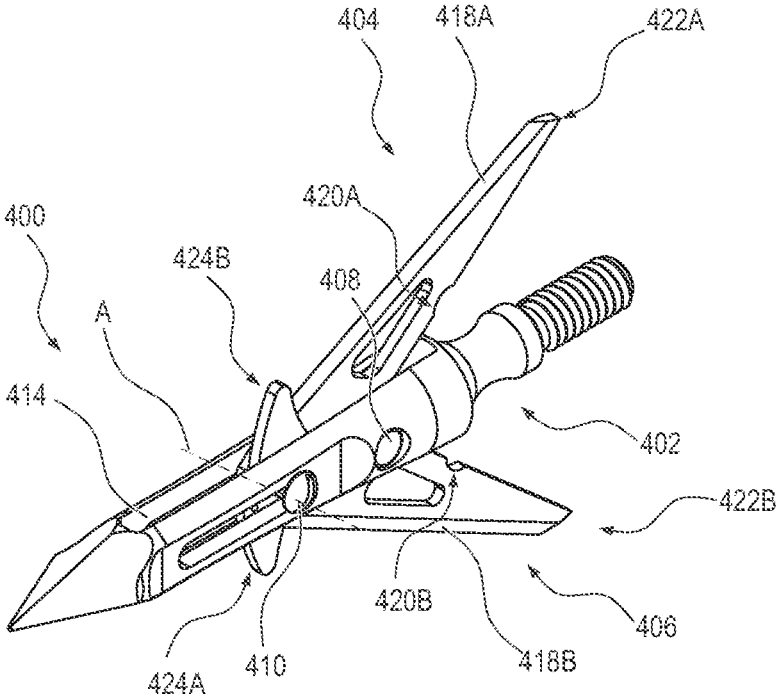
FIG. 4B is a perspective side view of the broadhead in a second configuration, according to some embodiments.
Figure 4C:
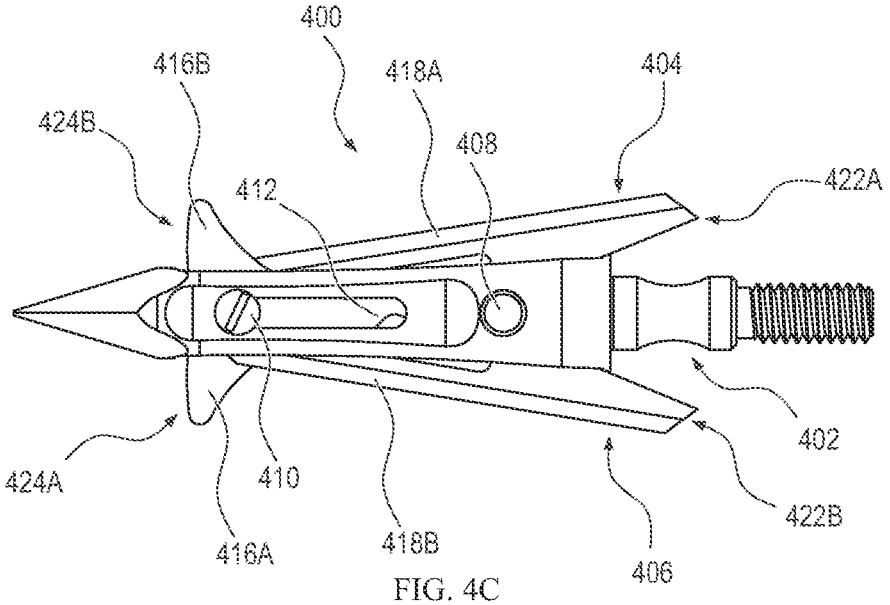
FIG. 4C is a top view of the broadhead in the first configuration, according to some embodiments.
Figure 4D:
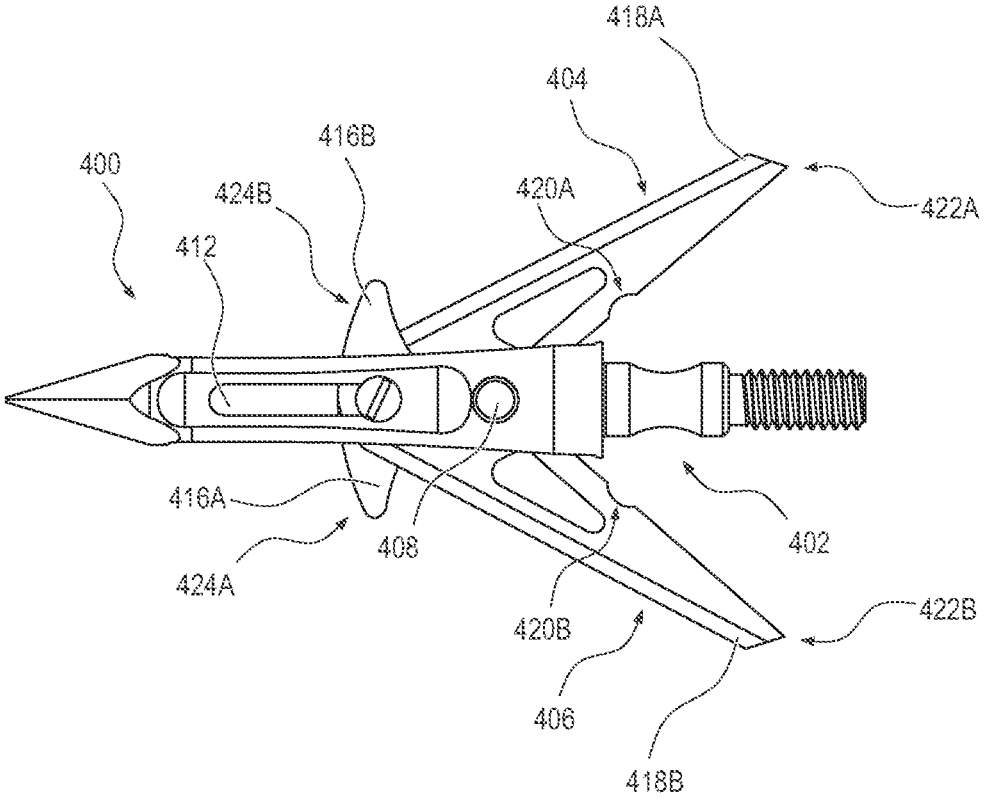
FIG. 4D is a top view of the broadhead in the second configuration, according to some embodiments.

FIGS. 4A-4D show another example of a broadhead 400 according to one or more aspects of the present disclosure. FIGS. 4A and 4C show the broadhead 400 in a first configuration (e.g., a retracted state). FIGS. 4B and 4D show the broadhead 400 in a second configuration (e.g., a deployed state). The broadhead 400 can be substantially similar to, and can include some or all of, the features of the broadheads 100, 200, 300. For example, the broadhead 400 can include a body or member 402, a first blade 404, a second blade 406, and a magnet 408. The member 402 can at least partially house the first blade 404 and/or the second blade 406. For example, the first and/or second blades 404, 406 can be pivotable and/or slidable about a fastener or other feature 410 coupled to the member 402. In other words, the first and/or second blades 404, 406 can be pivotable and translatable such that the blades are retractable and deployable relative to the member 402 (e.g., within a slot or channel 414). The feature 410 can be a fastener, a pin, or other structure defining an axis A the first and second blades 404, 406 can rotate about. The feature 410 can be disposed within a slot 412 defined by the member 402 such that the feature 410 can slide along the slot 412 when the broadhead 400 transitions between the first configuration and the second configuration.

The first blade 404 can be pivotably and slidably coupled to the member 402 about the feature 410. For example, the first blade 404 can include a lever-arm 416A that causes the first blade 404 to rotate and translate relative to member 402 when inertia drives the broadhead 400 into and through a target. Rotation and translation of the lever-arm 416A causes a blade portion 418A of the first blade 404 to further extend or deploy from the member 402 as shown in FIG. 4B. The second blade 406 can be pivotably and slidably coupled to the member 402 about the feature 410. For example, the second blade 406 can include a lever-arm 416B that causes the second blade 406 to rotate and slide relative to the member 402 when inertia drives the broadhead 400 into and through a target. Rotation and translation of the lever-arm 416B causes a blade portion 418B of the second blade 406 to further extend or deploy from the member 402 as shown in FIG. 4B.

In some examples, each of the first and second blades 404, 406 can include respective cutout regions 420A, 420B defining a section of a periphery of each of the blades 404, 406. In some examples, the cutout regions 420A, 420B can be disposed opposite the respective blade portions 418A, 418B. In some examples, the cutout regions 420A, 420B can be formed or defined nearer a distal end 422A, 422B than a proximal end 424A, 424B of their respective blades 404, 406. In some examples, the cutout regions 420A, 420B can be formed or defined nearer the proximal end 424A, 424B than the distal end 422A, 422B of their respective blades 404, 406. In some examples, each of the first and second blades 404, 406 can include a respective apertures 426A, 426B and the feature 410 can extend through the respective apertures 426A, 426B (see FIGS. 4E and 4F). The apertures 426A, 426B can enable rotation of the blades 404, 406 relative to the feature 410 and the axis A.

In some examples, the respective sections of each periphery of the first and second blades 404, 406 formed or defined by the respective cutout regions 420A, 420B can correlate to a shape of the magnet 408 disposed within the member 402. For example, the cutout regions 420A, 420B can be semi-circular if the magnet 408 is cylindrical such that the cutout regions 420A, 420B maximize a surface area the first and second blades 404, 406 contact the magnet 408 while the first and second blades 404, 406 are in the first configuration (i.e., retracted state). Or, stated another way, the cutout regions 420A, 420B can maximize a surface area of the magnet 408 contacted by a combination of the first and second blades 404, 406 while the broadhead 400 is in the first configuration (i.e., retracted state). In some examples, the cutout regions 420A, 420B can have linear segments correlating to a magnet 408 having a cuboid shape with one or more planar lateral sides.

Figure 4E:
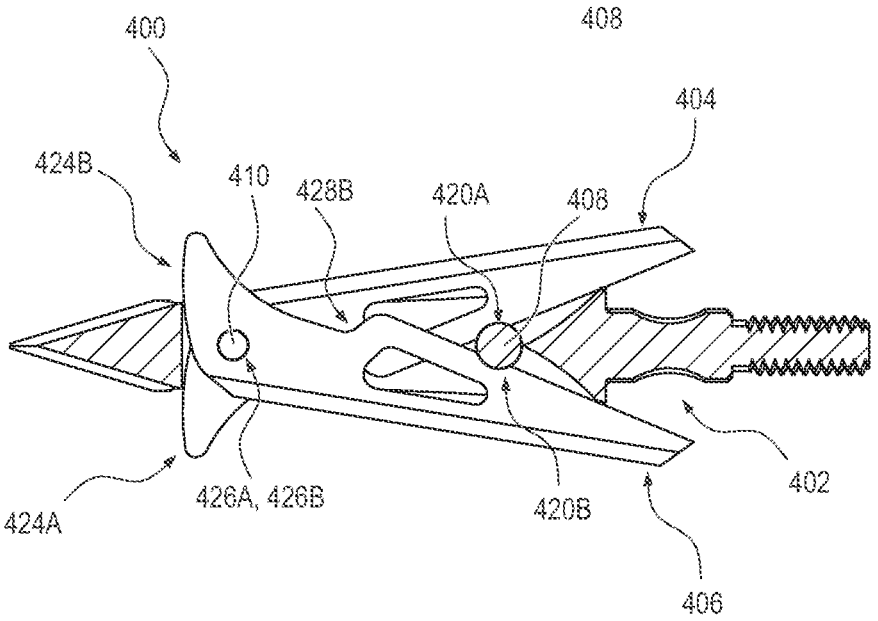
FIG. 4E is a cross-sectional top view of the broadhead in the first configuration, according to some embodiments.
Figure 4F:
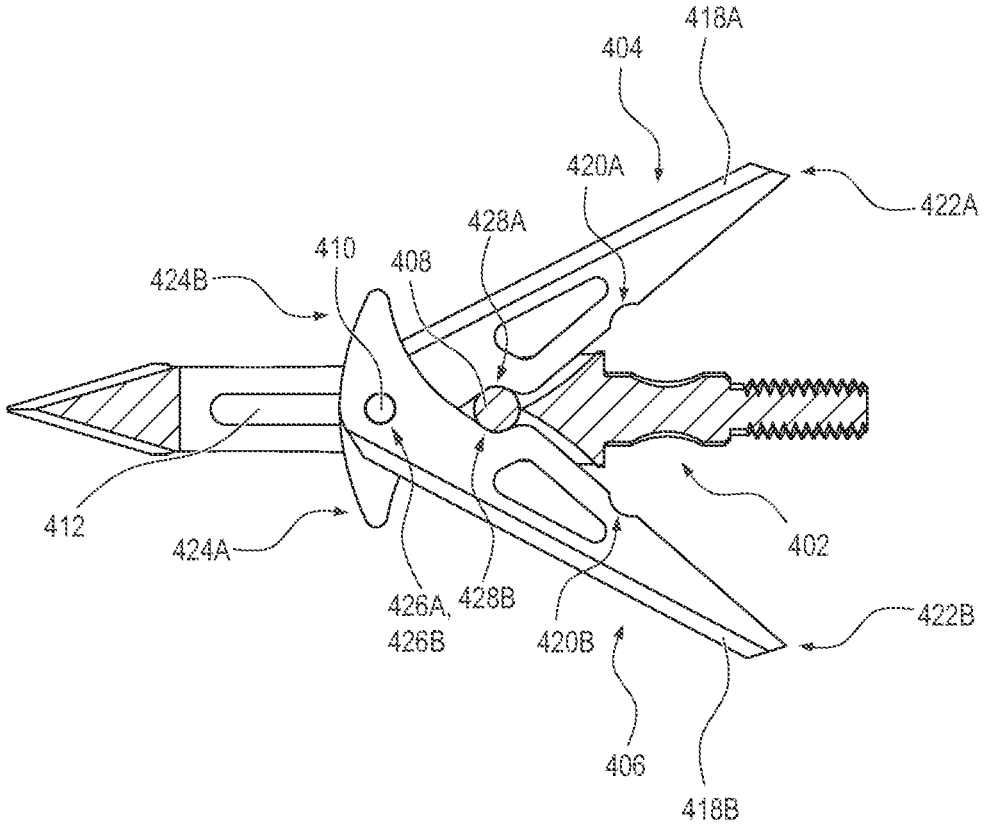
FIG. 4F is a cross-sectional top view of the broadhead in the second configuration, according to some embodiments.

FIGS. 4E and 4F show cross-sectional views of the broadhead 400 taken through a plane defined by (or positioned between or adjacent to) the first and second blades 404, 406 (see e.g., plane P in FIGS. 1D-1F). More specifically, FIG. 4E shows a cross-sectional view of the broadhead 400 in the first configuration and FIG. 4F shows a cross-sectional view of the broadhead 400 in the second configuration. In the first configuration, the first and second blades 404, 406 can contact or engage the magnet 408 at their respective cutout regions 420A, 420B. The contact or engagement between the cutout regions 420A, 420B and the magnet 408 can induce a magnetic force on the first and second blades 404, 406 to retain or maintain the broadhead 400 in the first configuration. As the broadhead 400 impacts and begins to pass through a target, the first and second blades 404, 406 can transition from the first configuration to the second orientation. During this transition, each of the cutout regions 420A, 420B can disengage or translate away from the magnet 408 as each of the first and second blades 404, 406 rotate relative to the feature 410. Simultaneously, each of the first and second blades 404, 406 can translate relative to the member 402 as the feature 410 translates along the slot 412.

As the first and second blades 404, 406 transition from the first configuration to the second configuration, the magnet 408 can continuously or intermittently contract or engage each of the first and second blades 404, 406 between their respective cutout regions 420A, 420B and their respective proximal ends 424A, 424B. For example, the first and second blades 404, 406 can translate relative to the magnet 408 to reach the second configuration wherein the magnet 408 is contacted by a secondary cutout regions 428A, 428B. In some examples, respective sections of each periphery of the first and second blades 404, 406 formed or defined by the respective secondary cutout regions 428A, 428B can correlate to a shape of the magnet 408 disposed within the member 402. For example, the secondary cutout regions 428A, 428B can be semi-circular if the magnet 408 is cylindrical such that the secondary cutout regions 428A, 428B maximize a surface area the first and second blades 404, 406 contact the magnet 408 while the first and second blades 404, 406 are in the second configuration (i.e., deployed state).

In some examples, the magnet 408 can contact or engage one or both of the first and second blades 404, 406 while the broadhead 400 is in both the first configuration (e.g., at the cutout regions 420A, 420B) and the second configuration (e.g., at the secondary cutout regions 428A, 428B). In some examples, the magnet 408 can act as a wedge which drives the distal ends 422A, 422B away from each other as the broadhead 400 transitions from the first configuration to the second configuration. Alternatively, the magnet 408 can contact or engage one or both of the first and second blades 404, 406 only while the broadhead 400 is in the first configuration (see e.g., FIGS. 1A-1I).

Aspects of the disclosure described herein relating to the gap G between the first and second blades and shown in FIGS. 1G, 1H, and 3C are equally applicable to the example broadhead 400. For example, any gap between the first and second blades 404, 406 adjacent the magnet 408 can be less than a diameter of the magnet 408. The gap can be determined or defined between by respective contact points where the first and second blades 404, 406 contact the magnet 408 (e.g., where the contact points are disposed nearest the proximal end of the member 402 while the broadhead 400 is in the first or second configuration). Alternatively, or additionally, the gap can be determined or defined between by other respective points where the first and second blades 404, 406 contact the magnet 408 (e.g., where such contact points are disposed nearest the distal end of the member 402 while the broadhead 400 is in the first or second configuration).

In some examples, the first blade 404 can contact the magnet 408 at a first location on the magnet 408 while the broadhead 400 is in the first configuration. See FIG. 4E. Similarly, the second blade 406 can contact the magnet 408 at a second location on the magnet 408 while the broadhead 400 is in the first configuration. See FIG. 4E. In some examples, the first blade 404 can contact the magnet 408 at a third location on the magnet 408, different from the first location, while the broadhead 400 is in the second configuration. See FIG. 4F. Similarly, the second blade 406 can contact the magnet 408 at a fourth location on the magnet 408, different from the second location, while the broadhead 400 is in the second configuration. In some examples, the first location and the third location can partially overlap. In some examples, the second location and the fourth location can partially overlap.

Figure 5A:
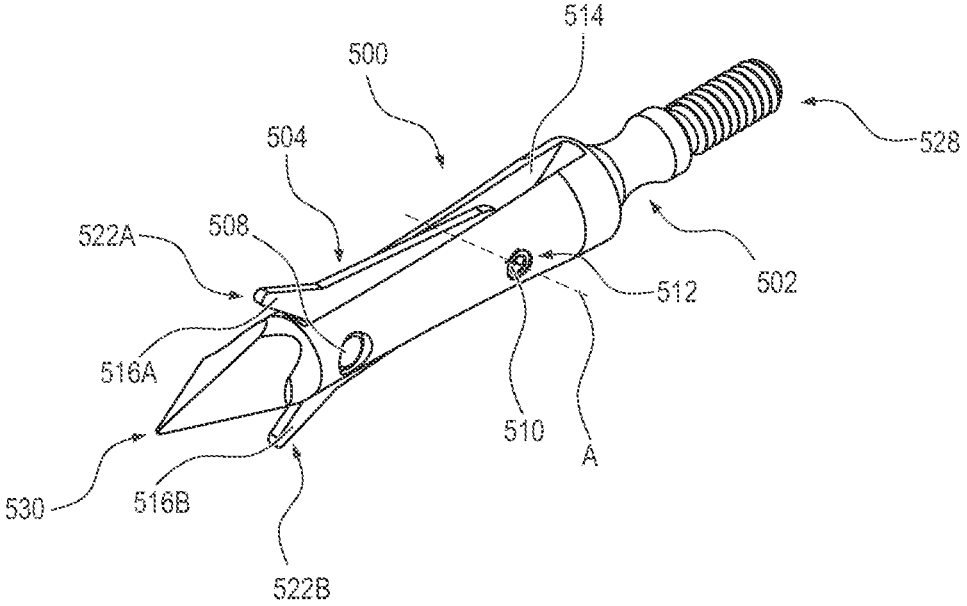
FIG. 5A is a perspective side view of a broadhead in a first configuration, according to some embodiments.
Figure 5B:
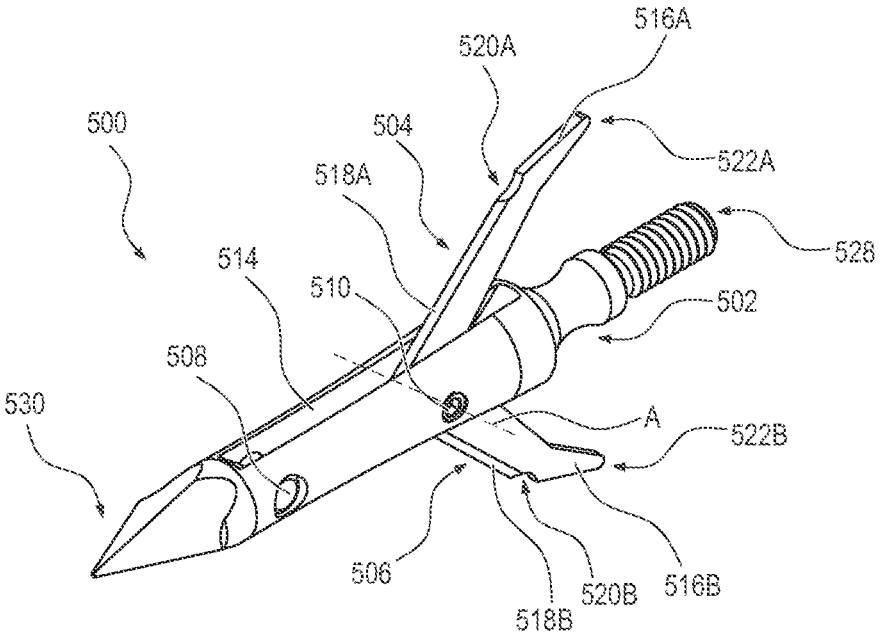
FIG. 5B is a perspective side view of the broadhead in a second configuration, according to some embodiments.
Figure 5C:
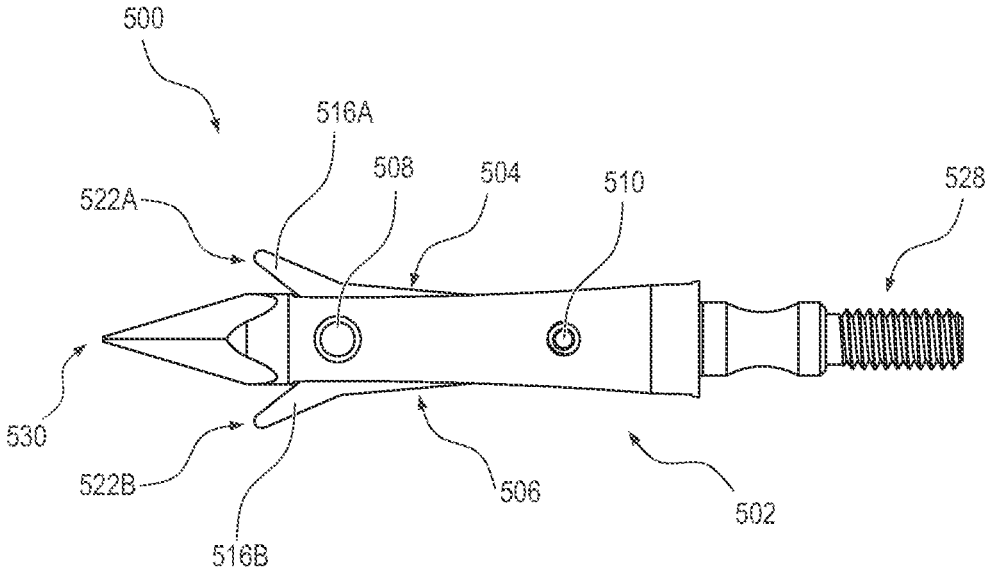
FIG. 5C is a top view of the broadhead in the first configuration, according to some embodiments.
Figure 5D:
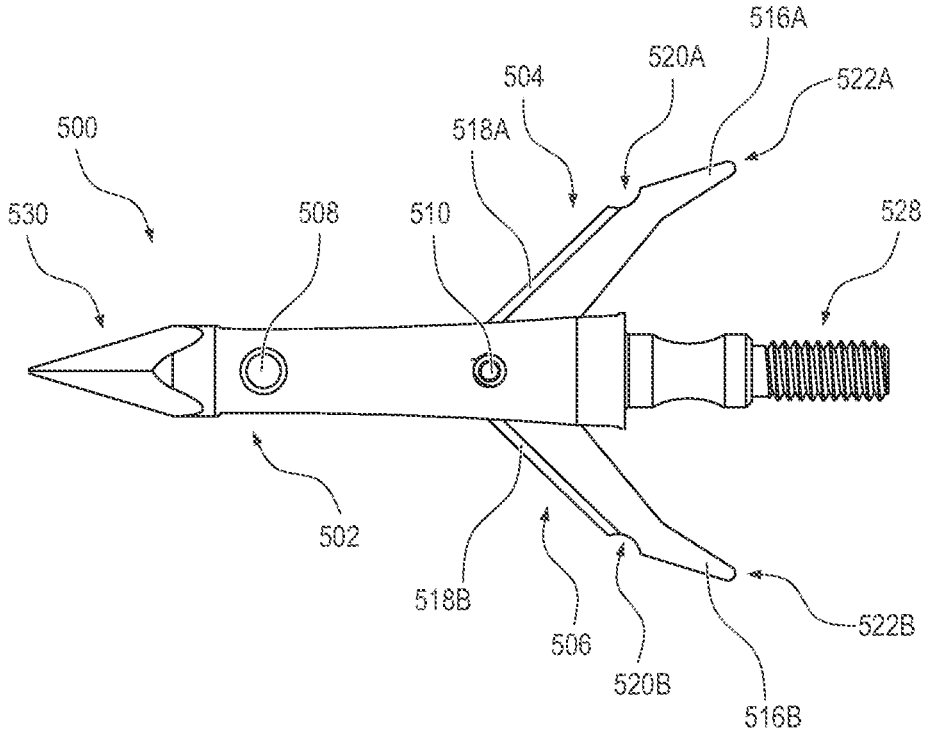
FIG. 5D is a top view of the broadhead in the second configuration, according to some embodiments.

FIGS. 5A-5D show another example of a broadhead 500 according to one or more aspects of the present disclosure. FIGS. 5A and 5C show the broadhead 500 in a first configuration (e.g., a retracted state). FIGS. 5B and 5D show the broadhead 500 in a second configuration (e.g., a deployed state). The broadhead 500 can be substantially similar to, and can include some or all of, the features of the broadheads 100, 200, 300, 400. For example, the broadhead 500 can include a body or member 502, a first blade 504, a second blade 506, and a magnet 508. The member 502 can at least partially house the first blade 504 and/or the second blade 506. For example, the first and/or second blades 504, 506 can be pivotable and/or slidable about a fastener or other feature 510 coupled to the member 502. In other words, the first and/or second blades 504, 506 can be pivotable such that the blades are retractable and deployable relative to the member 502 (e.g., within a slot or channel 514). The feature 510 can be a fastener, a pin, or other structure defining an axis A the first and second blades 504, 506 can rotate about. The feature 510 can be disposed within an aperture 512 defined by the member 502.

The first blade 504 can be pivotably coupled to the member 502 about the feature 510. For example, the first blade 504 can include an arm 516A that causes the first blade 504 to rotate about the axis A when inertia drives the broadhead 500 into and through a target. Rotation of the first blade 504 causes a blade portion 518A of the first blade 504 to extend or deploy from the member 502 as shown in FIG. 5B. The second blade 506 can be pivotably coupled to the member 502 about the axis A. For example, the second blade 506 can include an arm 516B that causes the second blade 506 to rotate about the axis A when inertia drives the broadhead 500 into and through a target. Rotation of the arm 516B causes a blade portion 518B of the second blade 506 to extend or deploy from the member 502 as shown in FIG. 5B.

In some examples, each of the first and second blades 504, 506 can include respective cutout regions 520A, 520B defining a section of a periphery of each of the blades 504, 506. In some examples, the cutout regions 520A, 520B can be disposed adjacent or abutting the respective blade portions 518A, 518B. In some examples, the cutout regions 520A, 520B can be formed or defined nearer a distal end 522A, 522B than a proximal end 524A, 524B of their respective blades 504, 506. In some examples, the cutout regions 520A, 520B can be formed or defined nearer the proximal end 524A, 524B than the distal end 522A, 522B of their respective blades 504, 506. In some examples, each of the first and second blades 504, 506 can include a respective apertures 526A, 526B and the feature 510 can extend through the respective apertures 526A, 526B (see FIGS. 5E and 5F). The apertures 526A, 526B can enable rotation of the blades 504, 506 relative to the feature 510 and the axis A.

In some examples, the respective sections of each periphery of the first and second blades 504, 506 formed or defined by the respective cutout regions 520A, 520B can correlate to a shape of the magnet 508 disposed within the member 502. For example, the cutout regions 520A, 520B can be semicircular if the magnet 508 is cylindrical such that the cutout regions 520A, 520B maximize a surface area the first and second blades 504, 506 contact the magnet 508 while the first and second blades 504, 506 are in the first configuration (i.e., retracted state). Or, stated another way, the cutout regions 520A, 520B can maximize a surface area of the magnet 508 contacted by a combination of the first and second blades 504, 506 while the broadhead 500 is in the first configuration (i.e., retracted state). In some examples, the cutout regions 520A, 520B can have linear segments correlating to a magnet 508 having a cuboid shape with one or more planar lateral sides. In some examples, the magnet 508 can be disposed nearer a proximal end 528 of the member 502 than a distal end 530 of the member 502.

Figure 5E:
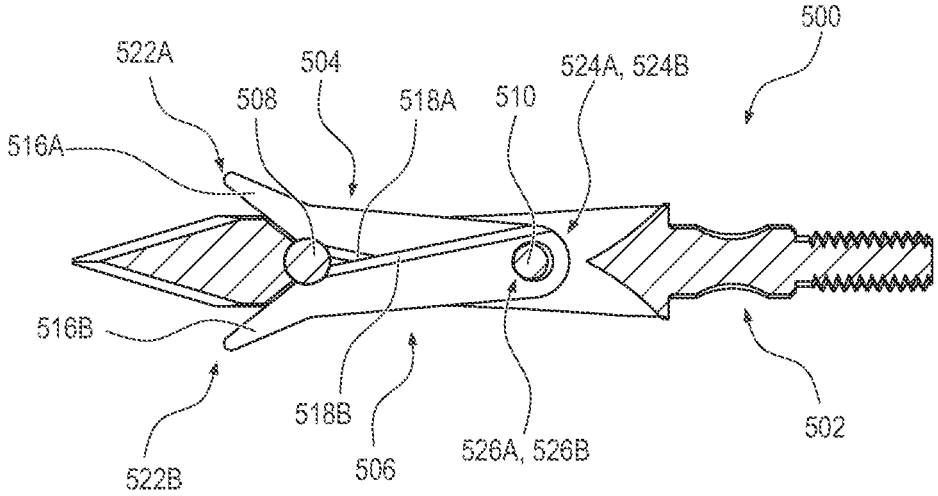
FIG. 5E is a cross-sectional top view of the broadhead in the first configuration, according to some embodiments.
Figure 5F:
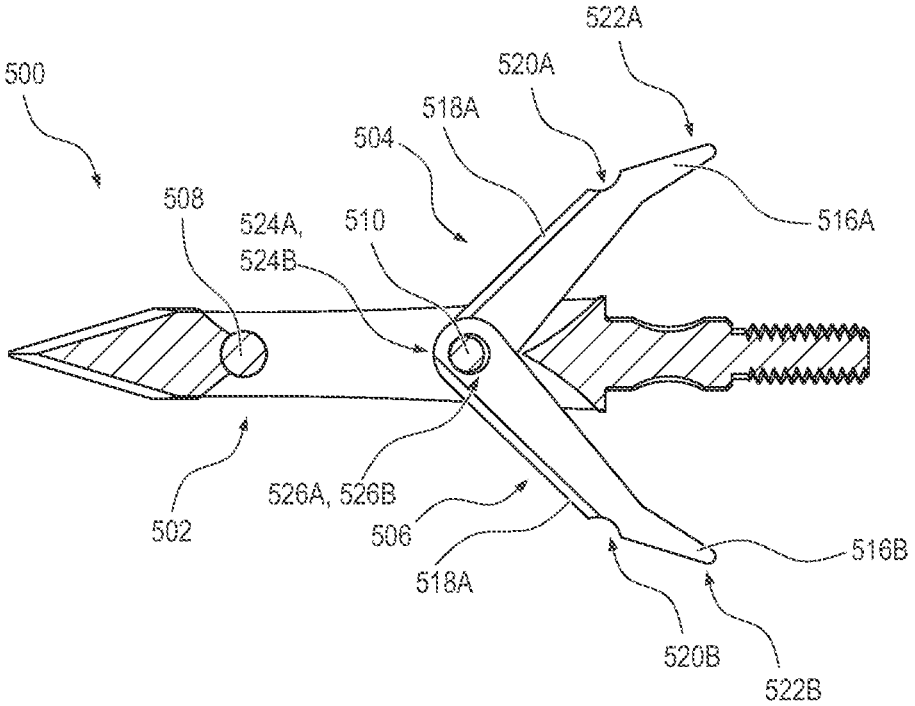
FIG. 5F is a cross-sectional top view of the broadhead in the second configuration, according to some embodiments.

FIGS. 5E and 5F show cross-sectional views of the broadhead 500 taken through a plane defined by (or positioned between or adjacent to) the first and second blades 504, 506 (see e.g., plane P in FIGS. 1D-1F). More specifically, FIG. 5E shows a cross-sectional view of the broadhead 500 in the first configuration and FIG. 5F shows a cross-sectional view of the broadhead 500 in the second configuration. In the first configuration, the first and second blades 504, 506 can contact or engage the magnet 508 at their respective cutout regions 520A, 520B. The contact or engagement between the cutout regions 520A, 520B and the magnet 508 can induce a magnetic force on the first and second blades 504, 506 to retain or maintain the broadhead 500 in the first configuration. As the broadhead 500 impacts and begins to pass through a target, the first and second blades 504, 506 can transition from the first configuration to the second orientation. More specifically, the target can contact the one or more of the arms 516A, 516B cause the first and/or second blades 504, 506 to rotate about the axis A from the first orientation to the second orientation. During this transition, each of the cutout regions 520A, 520B can disengage and rotate away from the magnet 508 as each of the first and second blades 504, 506 rotate relative to the feature 510.

Aspects of the disclosure described herein relating to the gap G between the first and second blades and shown in FIGS. 1G, 1H, and 3C are equally applicable to the example broadhead 500. For example, any gap between the first and second blades 504, 506 adjacent the magnet 508 can be less than a diameter of the magnet 508. The gap can be determined or defined between by respective contact points where the first and second blades 504, 506 contact the magnet 508 (e.g., where the contact points defining the gap are disposed nearest the proximal end 530 of the member 502). Alternatively, or additionally, the gap can be determined or defined between by other respective contact points where the first and second blades 504, 506 contact the magnet 508 (e.g., where such contact points are disposed nearest the distal end 528 of the member 502).

Figure 6A:
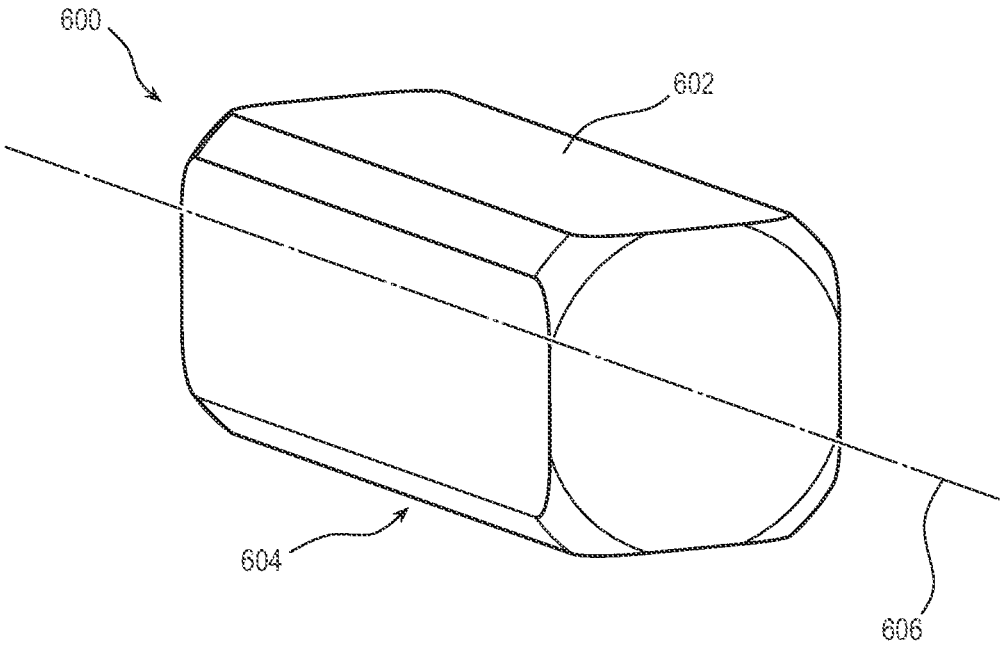
FIG. 6A is a perspective view of an example magnet, according to some embodiments.
Figure 6B:
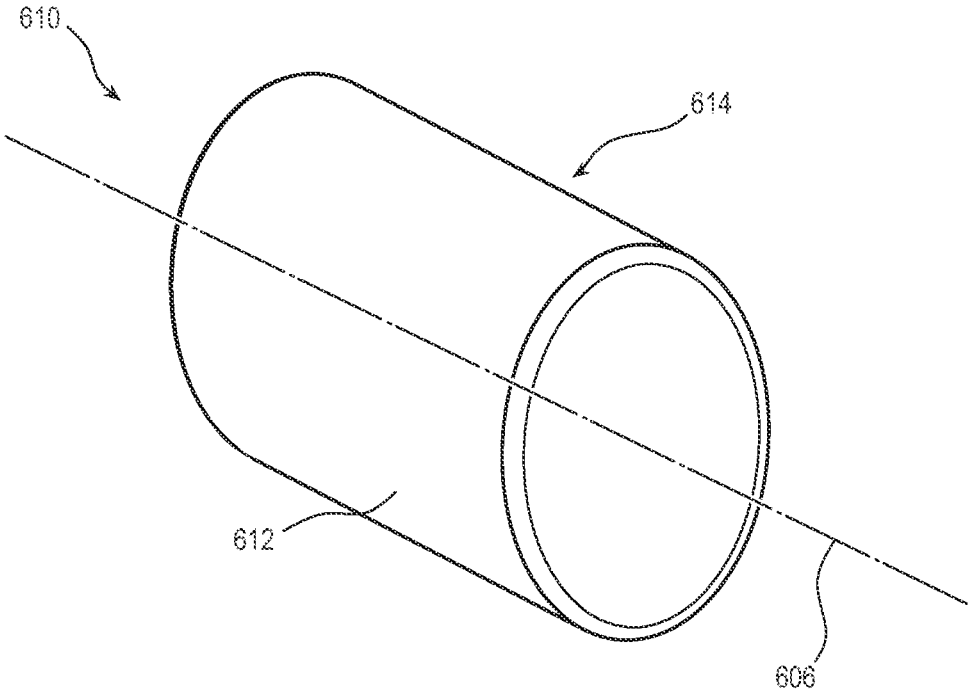
FIG. 6B is a perspective view of another example magnet, according to some embodiments.

As mentioned above, one or more blades of the present disclosure can include cutouts or contoured segments that are sized and shaped according to a magnet size and shape (and/or surface area). Thus, it will be appreciated that a broadhead as disclosed herein can include magnets of a wide variety of shapes and sizes (including shapes other than cylindrical-shaped magnets shown in the foregoing figures). In accordance with one or more such examples, FIGS. 6A-6B illustrate perspective views of example magnets. In particular, FIG. 6A illustrates a magnet 600 having a cuboid form factor. In contrast, FIG. 6B illustrates a magnet 610 having an elliptically shaped cylindrical magnet.

Both the magnet 600 and the magnet 610 can have the same or similar magnetic properties as one or more magnets discussed above, such as the magnet 108. In addition, the magnet 600 and the magnet 610 can each include a longitudinal axis 606. In some examples, the longitudinal axis 606 can extend through a centroid from one end of the magnets 600, 610 to the other end of the magnets 600, 610, and along the longest dimension. In other words, the longitudinal axis 606 can extend through the center of curvature (i.e., at the radius or center point) of the magnets 600, 610 and between the north and south poles on opposing ends.

In particular, the magnet 600 in FIG. 6A includes a first sidewall 602 and a second sidewall 604 (among others). The first sidewall 602 and the second sidewall 604 (oppositely positioned relative to each other) can respectively contact a first blade and a second blade of a broadhead as disclosed herein. For example, a blade segment of the first blade (not shown) can contact (e.g., lay flat against) the first sidewall 602, and the second blade (not shown) can contact (e.g., lay flat against) the second sidewall 604. Additionally or alternatively, the blade segments of the first and second blades can wrap around or otherwise contact other sidewalls (e.g., adjacent sidewalls) of the magnet 600. In certain examples where a given blade contacts multiple sidewalls of the magnet 600, the magnet 600 can impart increased retention capability for positionally retaining the blades in a configuration.

With respect to the magnet 610 of FIG. 6B, the magnet 610 can include a cylindrical shape with an elliptical cross-section defined by a first elliptical face 612 and a second elliptical face 614 opposite the first elliptical face 612. In these or other examples, the first elliptical face 612 and the second elliptical face 614 can respectively contact blade cutouts or segments of first and second blades (not shown) that are correspondingly shaped in an elliptical manner (e.g., with matching radii). For example, a blade segment of the first blade (not shown) can contact (e.g., at least partially circumscribe) the first elliptical face 612, and the second blade (not shown) can contact (e.g., at least partially circumscribe) the second elliptical face 614.

Additionally or alternatively to the foregoing, other shaped magnets are herein contemplated. For example, a magnet of the present disclosure can include non-uniform radii, such as an elliptically shaped cylindrical magnet having an egg-shaped form factor. Other magnets can include spherical magnets, pyramidal magnets, or other suitable three-dimensional polygonal shaped magnets.

In some examples, changes may be made in the function and arrangement of archery components or products discussed without departing from the spirit and scope of the disclosure, and various embodiments may omit, substitute, or add other components or accessories as appropriate. For instance, one or more portions incorporated into a particular component described with respect to certain embodiments may be combined in other embodiments.

Various aspects have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising".

What is claimed:

1. A broadhead for an arrow, the broadhead comprising:
a member;
a first blade pivotably coupled to the member;
a second blade pivotably coupled to the member, the first blade and the second blade forming a plane; and
a magnet disposed within the member, the magnet having a longitudinal axis extending perpendicular to the plane.

2. The broadhead of claim 1, wherein the magnet is diametrically magnetized.

3. The broadhead of claim 1, wherein;
the first blade is pivotable about an axis of rotation;
the second blade is pivotable about the axis of rotation; and
the axis of rotation extends parallel to the longitudinal axis.

4. The broadhead of claim 1, wherein:
the first blade and the second blade contact the magnet in a first configuration; and
the first blade and the second blade are displaced from the magnet in a second configuration.

5. The broadhead of claim 4, wherein:
the magnet is cylindrical; and
the first blade and the second blade contact a sidewall of the cylinder in the first configuration.

6. The broadhead of claim 4, wherein:
the magnet is a cuboid;
the first blade contacts a first sidewall of the cuboid in the first configuration; and
the second blade contacts a second sidewall of the cuboid in the first configuration.

7. The broadhead of claim 1, wherein the longitudinal axis extends orthogonal to the plane.

8. The broadhead of claim 1, wherein the member defines a proximal end configured to engage a component for coupling the broadhead to an arrow shaft.

9. The broadhead of claim 8, wherein the magnet is disposed closer to the proximal end than a distal end of the member.

10. The broadhead of claim 1, wherein a first pole of the magnet and a second pole of the magnet are disposed on respective curved surfaces located on opposite sides of the magnet.

11. A broadhead for an arrow, the broadhead comprising:
a body;
a first blade coupled to the body;
a second blade coupled to the body; and
a magnet disposed within the body, wherein the first blade and the second blade are positionable in a first configuration and a second configuration, and wherein the first blade and the second blade both contact the magnet in each of the first configuration and the second configuration.

12. The broadhead of claim 11, wherein;
the first blade comprises a first cutout region along a periphery of the first blade and a second cutout region along the periphery of the first blade;
the second blade comprises a third cutout region along a periphery of the second blade and a fourth cutout region along the periphery of the second blade; and
the first cutout region and the third cutout region contact the magnet when the first blade and the second blade are positioned in the first configuration, and the second cutout region and the fourth cutout region contact the magnet when the first blade and the second blade are positioned in the second configuration.

13. The broadhead of claim 12, wherein the first cutout region and the third cutout region are displaced from the magnet in the second configuration.

14. The broadhead of claim 12, wherein:
the first blade contacts the magnet at a first location on the magnet in the first configuration;
the second blade contacts the magnet at a second location on the magnet in the first configuration;
the first blade contacts the magnet at a third location on the magnet in the second configuration; and
the second blade contacts the magnet at a fourth location on the magnet in the second configuration.

15. The broadhead of claim 14, wherein the first blade is repositionable relative to the body while transitioning between the first configuration and the second configuration.

16. The broadhead of claim 11, wherein the magnet is disposed closer to a distal end of the body than a proximal end of the body.

17. A broadhead for an arrow, the broadhead comprising:
a member;
a first blade coupled to the member via a feature defining an axis of rotation for the first blade;

a second blade coupled to the member via the feature further defining an axis of rotation for the second blade; and a magnet coupled to the member, the magnet having a diameter, the first blade having a first point of contact on the magnet, the second blade having a second point of contact on the magnet, the first point of contact and the second point of contact defining a gap between the first blade and the second blade, the gap being less than the diameter.

18. The broadhead of claim 17, wherein the member has a proximal end and a distal end, the feature being nearer the proximal end than the distal end.

19. The broadhead of claim 17, wherein the member has a proximal end and a distal end, the first point of contact and the second point of contact being nearer the distal end than the proximal end.

20. The broadhead of claim 17, wherein the magnet is diametrically magnetized.

* * * * *